US007140405B2

(12) United States Patent
Lewis et al.

(10) Patent No.: US 7,140,405 B2
(45) Date of Patent: Nov. 28, 2006

(54) MIXING APPARATUS

(75) Inventors: William Lewis, DePere, WI (US); James R. Slade, Green Bay, WI (US)

(73) Assignee: Relevant Engineering Development, Green Bay, WI (US)

( * ) Notice: Subject to any disclaimer, the term of this patent is extended or adjusted under 35 U.S.C. 154(b) by 270 days.

(21) Appl. No.: 10/878,100

(22) Filed: Jun. 28, 2004

(65) Prior Publication Data

US 2004/0264295 A1 Dec. 30, 2004

Related U.S. Application Data

(60) Provisional application No. 60/482,668, filed on Jun. 26, 2003.

(51) Int. Cl.
*B65B 1/04* (2006.01)

(52) U.S. Cl. ..... 141/104; 141/100; 366/160.2

(58) Field of Classification Search ..... 141/9, 141/100, 104; 366/160.2, 160.3, 160.4
See application file for complete search history.

(56) References Cited

U.S. PATENT DOCUMENTS

| | | | |
|---|---|---|---|
| 594,577 | A | 11/1897 | Suppes |
| 2,220,099 | A | 11/1940 | Guenther et al. |
| 2,477,383 | A | 7/1949 | Lewis |
| 2,539,615 | A | 1/1951 | Fox et al. |
| 2,683,295 | A | 7/1954 | Howlett et al. |
| 3,012,024 | A | 12/1961 | Kavesh |
| 3,042,266 | A | 7/1962 | Mies |
| 3,123,640 | A | 3/1964 | Longley |
| 3,141,905 | A | 7/1964 | Longley |
| 3,156,655 | A | 11/1964 | Bright |
| 3,222,201 | A | 12/1965 | Boyle |
| 3,222,213 | A | 12/1965 | Clark |
| 3,332,880 | A | 7/1967 | Kessler et al. |
| 3,382,178 | A | 5/1968 | Lissant et al. |
| 3,383,323 | A | 5/1968 | Irani |
| 3,457,109 | A | 7/1969 | Peist |
| 3,518,099 | A | 6/1970 | Holbus |
| 3,537,993 | A | 11/1970 | Coward et al. |
| 3,578,211 | A | 5/1971 | Coapman et al. |
| 3,591,147 | A | 7/1971 | Anderson et al. |
| 3,609,089 | A | 9/1971 | Cantrell et al. |
| 3,679,608 | A | 7/1972 | Aubert et al. |
| 3,717,630 | A | 2/1973 | Booth |
| 3,816,351 | A | 6/1974 | Lancz |
| 4,111,855 | A | 9/1978 | Barrat et al. |
| 4,170,565 | A | 10/1979 | Flesher et al. |

(Continued)

OTHER PUBLICATIONS

Sharpe Mixers; Operation & Maintenance Manual for Sharpe Mixers Liquid Agitation Equipment; Serial No. 44494; Document No. 0051848.05, Aug. 27, 1998; pp. 1-12.

(Continued)

*Primary Examiner*—Steven O. Douglas
(74) *Attorney, Agent, or Firm*—Michael Best & Friedrich LLP

(57) ABSTRACT

The present invention provides an apparatus adapted to dilute pre-measured raw chemical material. The apparatus includes a tank selectively fluidly connectable to a source of pressurized diluent by a passageway and a first pump selectively fluidly connectable to the passageway. The first pump pumps the pre-measured raw chemical material from a first container through the passageway to the tank to mix with diluent in the tank. The apparatus also includes a second pump selectively fluidly connectable to the passageway. The second pump pumps the diluted raw chemical material from the tank through the passageway to a second container.

14 Claims, 8 Drawing Sheets

U.S. PATENT DOCUMENTS

| | | | | | |
|---|---|---|---|---|---|
| 4,171,710 | A | * | 10/1979 | Boynton et al. | 137/238 |
| 4,221,309 | A | | 9/1980 | Mezger | |
| 4,222,905 | A | | 9/1980 | Cockrell | |
| 4,228,042 | A | | 10/1980 | Letton | |
| 4,228,044 | A | | 10/1980 | Cambre | |
| 4,259,217 | A | | 3/1981 | Murphy | |
| 4,260,529 | A | | 4/1981 | Letton | |
| 4,284,435 | A | | 8/1981 | Fox | |
| 4,321,165 | A | | 3/1982 | Smith et al. | |
| 4,407,431 | A | | 10/1983 | Hutter, III | |
| 4,660,990 | A | | 4/1987 | Svensson | |
| 4,703,780 | A | | 11/1987 | Reeves, Jr. et al. | |
| 4,865,773 | A | | 9/1989 | Kim et al. | |
| 4,883,202 | A | | 11/1989 | Wahl | |
| 4,954,037 | A | | 9/1990 | Habicht | |
| 5,020,917 | A | | 6/1991 | Homan | |
| 5,069,370 | A | | 12/1991 | Cady et al. | |
| 5,234,268 | A | | 8/1993 | Homan | |
| 5,406,996 | A | | 4/1995 | Wagner et al. | |
| 5,484,004 | A | | 1/1996 | Bolz | |
| 5,678,593 | A | * | 10/1997 | Lockhart | 137/268 |
| 5,699,589 | A | | 12/1997 | Ripley et al. | |
| 5,725,678 | A | | 3/1998 | Cannon et al. | |
| 5,823,670 | A | | 10/1998 | Rushing et al. | |
| 5,855,232 | A | | 1/1999 | Oda et al. | |
| 5,897,671 | A | * | 4/1999 | Newman et al. | 8/158 |
| 5,927,552 | A | | 7/1999 | Toshima | |
| 5,979,472 | A | | 11/1999 | Lowery et al. | |
| 5,996,848 | A | | 12/1999 | Sperry et al. | |
| 6,053,219 | A | | 4/2000 | Seiver | |
| 6,140,659 | A | | 10/2000 | Shizuka | |
| 6,179,969 | B1 | | 1/2001 | Larsen | |
| 6,227,695 | B1 | | 5/2001 | Kubiak et al. | |
| 6,230,934 | B1 | | 5/2001 | Kramer | |
| 6,764,212 | B1 | * | 7/2004 | Nitta et al. | 366/114 |
| 2002/0196703 | A1 | | 12/2002 | Rumph | |

OTHER PUBLICATIONS

Plast-O-Matic Valves, Inc.; Assembly, Installation & Operating Instructions for TRUE-BLUE™ Air Actuator; Jun. 1997; pp. 1-4.

Plast-O-Matic Valves, Inc.; TRUE-BLUE™ Ball Valves Installation Instructions; p. 1.

Plast-O-Matic Valves, Inc.; Assembly, Installation & Operating Instructions for TRUE-BLUE™ 2.5 Air Actuators ABRA, ABRS & ABMS; Copyright 2001; pp. 1-4.

Carlo Gavazzi; Capacitive Sensors Installation and Adjustment Guide; Jun. 17, 1999; Printed in Denmark; pp. 1-6.

Siemens; General Licence Conditions for Software Products for Automation and Drives; Copyright 1995, pp. 1-12.

Plast-O-Matic; TRUE-BLUE™ Series ALSR and SLSR Limit Stop Option for True Blue Series ABR Air Actuated Ball Valves; Jun. 1999; pp. 1-2.

Graco; Graco Warranties; Printed in U.S.A.; 308443; Oct. 1994, Revised Oct. 2002; p. 1.

Gast Manufacturing Co., Ltd; Unit of IDEX Corporation; Air Motors Operational Instructions; Oct. 1999; Pamphlet.

Bedienungs-FLUX; Operating Instructions Motors for Barrel and Container Pumps; pp. 10-17.

Vibco, Inc.; Ball Type Vibrators; Installation of Flange Mounted Vibrators on Hoppers and Chutes; pp. 1-6.

Mead Fluid Dynamics, Inc.; Isonic® 4000 Series Manifold Installation & Maintenance; Jun. 2000; 1 sheet.

Speedaire®; Speedaire® Micromist Lubricator Operating Instructions & Parts Manual; Printed in U.S.A.; Form 5S4386; pp. 1-4.

Speedaire®; Speedaire® Regulators Operating Instructions & Parts Manual; Printed in U.S.A.; Form 5S4394; pp. 1-4.

Speedaire®; Speedaire® SpeedClamp Operating Instructions & Parts Manual; Printed in U.S.A.; Form 5S4355; pp. 1-4.

Ametek; Uso E Instalación De Los Manómetros; Formulario #1421S; pp. 1-2. (No English Translation).

Dema Normally Open Solenoid Valves; Installation instructions; Form I-208; pp. 1-2.

Siemens; Data Sheet; Simatic S7-200 EM 241 Modem Modul; Copyright 2001 by Siemens Energy & Automation, Inc.; pp. 1-2.

Ingersoll-Rand Company; General Information Air Operated Diaphragm Pumps; Copyright 2001; pp. 1-28.

Ingersoll-Rand Company; Operator's Manual 6661AX-X-C; Sep. 11, 1989, Revised May 25, 2001; pp. 1-8.

Graco Inc. ; Instructions—Parts List; Acetal, Polypropylene and Kynar® Husky™ 1040 Air-Operated Diaphragm Pumps; Copyright 1994, pp. 1-35.

Stahlin; Control Enclosures Type 12 Series Enclosures; http://www.stahlin.com/catalog/FiberGlass/CET12.html; Date accessed Jun. 1, 2003; pp. 1-2.

Siemens; Simatic S7-200 New Products; Printed in Germany; pp. 1-6.

Siemens Energy & Automation; http://www.sea.siemens.com/controls/product/s7200/CNs7200.htm; Date accessed Jun. 1, 2003; pp. 1-4.

Chem-Tainer Industries, Inc.; Promotional materials; pp. 1-3.

Control Cabinet Major Components; Product list; pp. 1-11.

* cited by examiner

MIXING APPARATUS

RELATED APPLICATIONS

This application claims priority to now abandoned U.S. Provisional Patent Application Ser. No. 60/482,668 filed on Jun. 26, 2003, the entire contents of which is incorporated herein by reference.

FIELD OF THE INVENTION

The invention relates generally to a mixing apparatus, methods using the same and business methods related thereto.

BACKGROUND OF THE INVENTION

In the vehicle washing industry, chemical suppliers conventionally purchase the raw materials used in producing different detergent and/or protection product solutions from commodity and specialty chemical companies. As used in conventional industry practice, a "chemical supplier" is meant to refer to an entity that provides finished products to the professional vehicle-washing market. The chemical suppliers utilize their expertise to measure portions of the raw materials, mix and dilute the portions of raw materials to produce a particular detergent and/or protection product solution, and package the mixed and diluted detergent and/or protection product solution into individual containers for sale to localized distributors. As used in conventional industry practice, a "conventional distributor" is an entity that is a value-added reseller in the professional vehicle-washing market.

SUMMARY OF THE INVENTION

The methods and apparatuses of the present invention allow other entities, not previously considered "chemical suppliers" in the traditional industry sense, to utilize their expertise and measure appropriate portions of the raw materials to form a pre-measured raw chemical material.

The methods and apparatuses of the present invention also allow distributors to receive the pre-formulated, pre-measured mix of raw materials and provide finished products to the professional vehicle-washing market.

In one aspect, the present invention provides an automated mixing apparatus for mixing raw materials used in cleaning and protection products, as well as methods of using the apparatus and business methods related thereto.

In another aspect, the present invention provides an apparatus adapted to dilute pre-measured raw chemical material. The apparatus includes a tank selectively fluidly connectable to a source of pressurized diluent by a passageway and a first pump selectively fluidly connectable to the passageway. The first pump pumps the pre-measured raw chemical material from a first container through the passageway to the tank to mix with diluent in the tank. The apparatus also includes a second pump selectively fluidly connectable to the passageway. The second pump pumps the diluted raw chemical material from the tank through the passageway to a second container.

Other features and aspects of the present invention will become apparent to those skilled in the art upon review of the following detailed description, claims and drawings.

BRIEF DESCRIPTION OF THE DRAWINGS

In the drawings, wherein like reference numerals indicate like parts.

Figure 1:
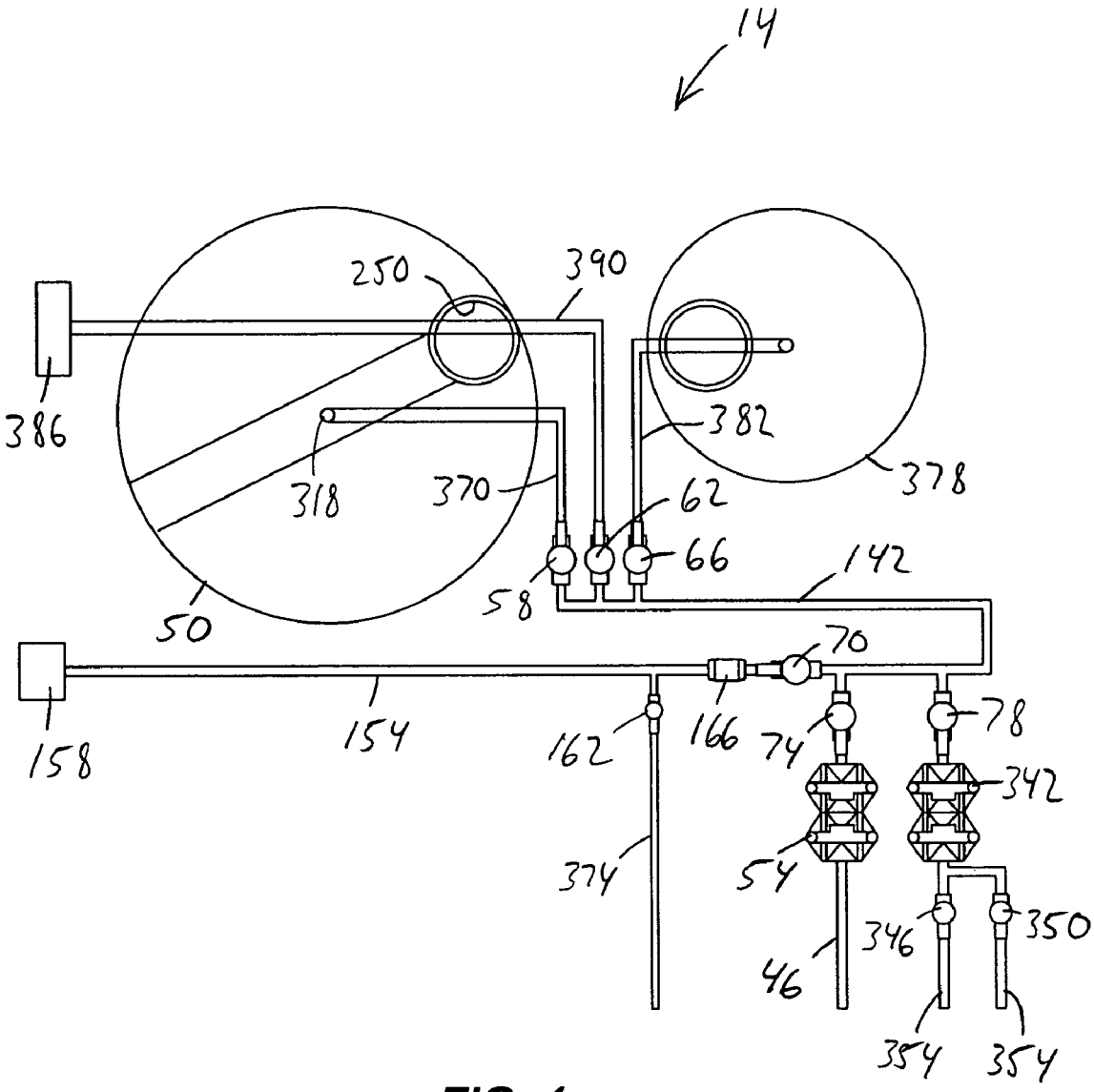
FIG. 1 is a schematic illustrating a fluid diagram of an automated mixing apparatus.

Before any features of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including", "having", and "comprising" and variations thereof herein is meant to encompass the items listed thereafter and equivalents thereof as well as additional items. The use of letters to identify elements of a method or process is simply for identification and is not meant to indicate that the elements should be performed in a particular order.

DETAILED DESCRIPTION

Figure 2:
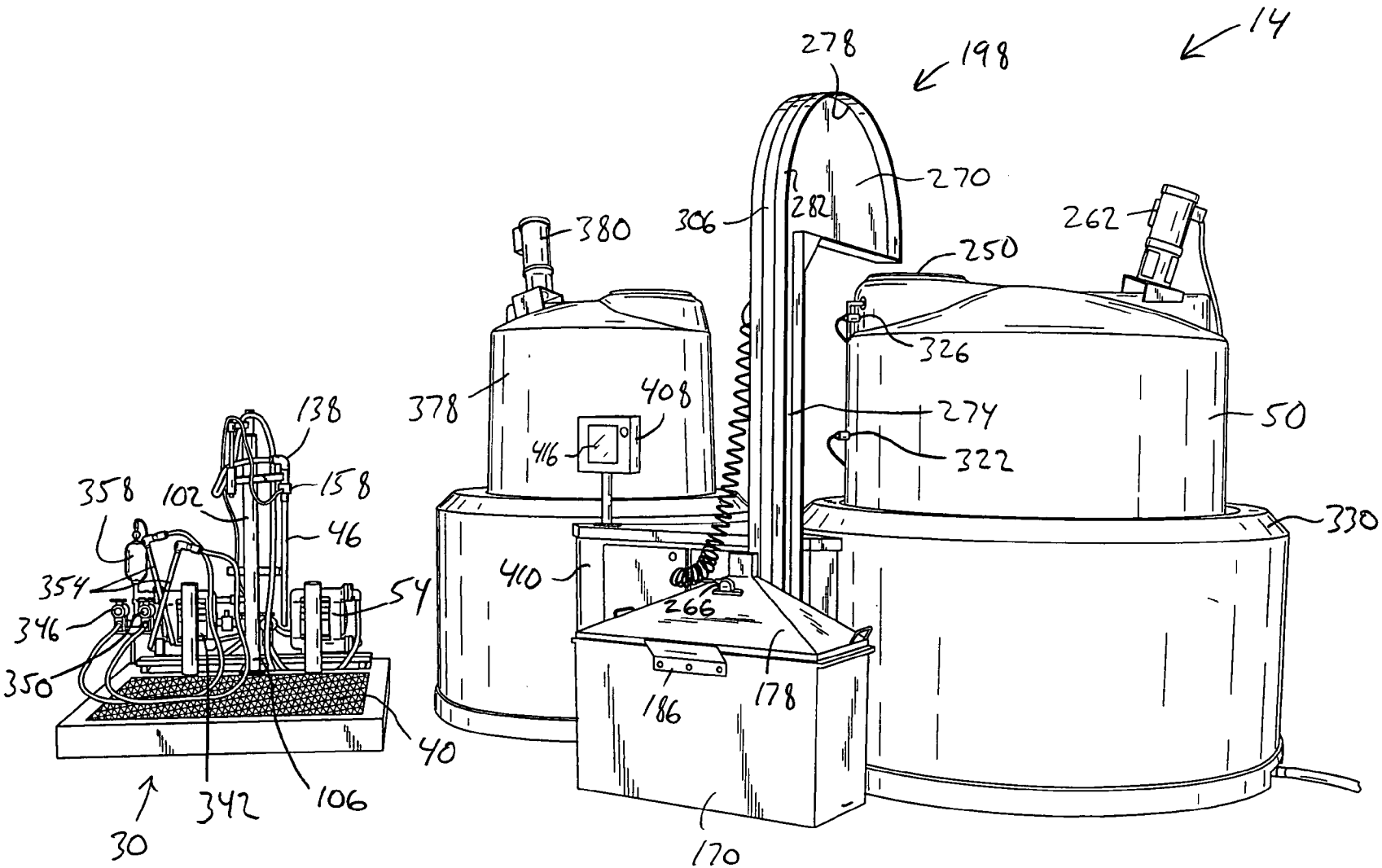
FIG. 2 is a front perspective view of the automated mixing apparatus of FIG. 1.

FIGS. 1 and 2 illustrate an automated mixing apparatus 14 of the present invention. The apparatus 14 may be used in a wide variety of applications including, but not limited to, the manufacture of cleaning and protection products for the ground transportation cleaning market. In one embodiment, the apparatus 14 may be used to produce a detergent solution and/or a protection product solution for use in a washing/cleaning/waxing and conditioning apparatus. The mixing apparatus 14 is capable of automatically mixing both liquid and particulate raw materials 18, 22 with water to produce the detergent and/or protection product solutions. Alternatively, the automated mixing apparatus 14 may be configured to mix any number of different liquid and/or particulate raw materials 18, 22 to produce a final product solution.

Figure 3A:
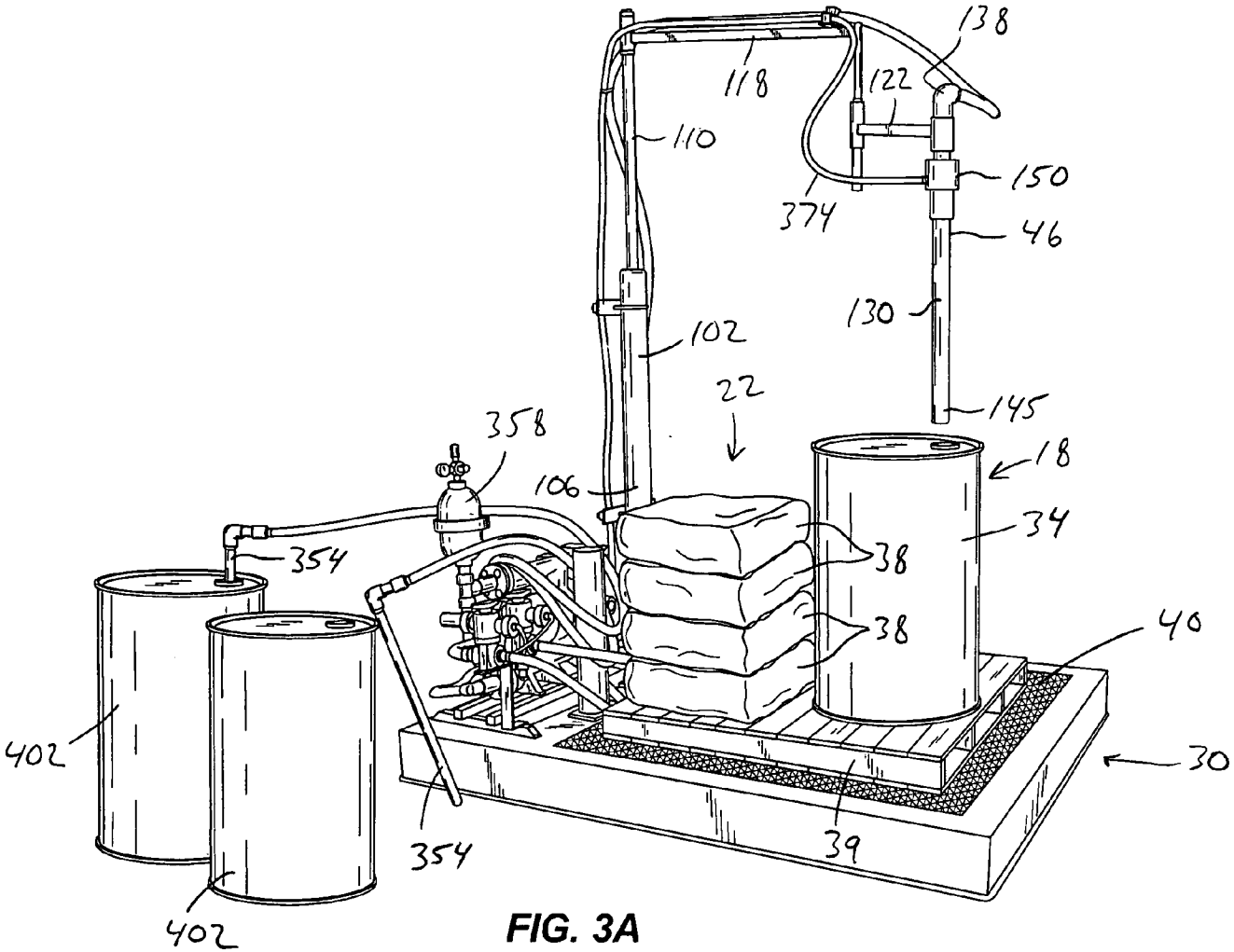
FIG. 3A is an enlarged front perspective view of a raw material platform of the automated mixing apparatus of FIG. 1.
Figure 3B:
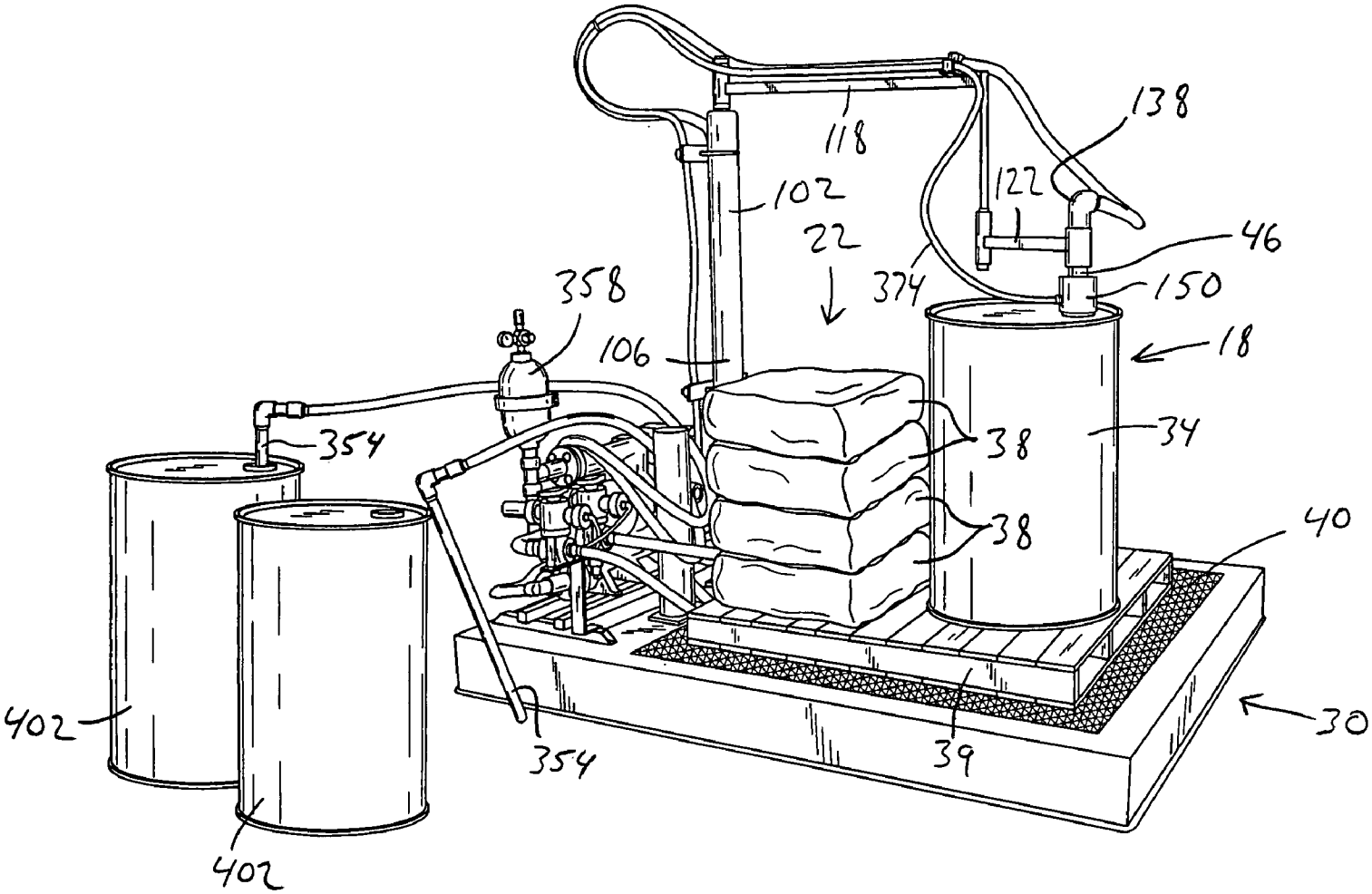
FIG. 3B is an enlarged front perspective view of the raw material platform of FIG. 3A, illustrating a swivelable pickup wand being inserted into a drum of liquid raw materials.

The apparatus 14 includes a raw material platform 30 (see FIGS. 2–3B). The raw material platform 30 supports various liquid raw materials 18 stored in drums 34 and various packages 38 of particulate raw materials 22 (collectively "pre-measured or pre-formulated raw chemical materials, mixes, or mixtures"). The pre-measured or pre-formulated raw chemical materials or mixtures may comprise liquid raw material, particulate raw material, or both. The liquid raw materials 18 may include at least one of an alkaline or acid (e.g., sodium hydroxide), liquid chelant, surfactant, solvent, polymer, stabilizing agent, viscosity control agent, fragrance, dye, and combinations thereof.

Examples of surfactants include, but are not limited to, nonionic surfactants, cationic surfactants, anionic surfactants, amphoteric surfactants, and combinations thereof.

Nonionic surfactants are conventionally produced by condensing ethylene oxide with a hydrocarbon having a reactive hydrogen atom, e.g., a hydroxyl, carboxyl, amino, or amido group, in the presence of an acidic or basic catalyst. Nonionic surfactants may have the general formula $RA(CH_2CH_2O)_nH$ wherein R represents the hydrophobic moiety, A represents the group carrying the reactive hydrogen atom and n represents the average number of ethylene oxide moieties. R may be a primary or a secondary, straight or slightly branched, aliphatic alcohol having from about 8 to about 24 carbon atoms. A more complete disclosure of nonionic surfactants can be found in U.S. Pat. No. 4,111,855 issued to Barrat, et al. and U.S. Pat. No. 4,865,773, Kim et al., issued Sep. 12, 1989, which are hereby incorporated by reference.

Other nonionic surfactants include ethoxylated alcohols or ethoxylated alkyl phenols wherein A is a hydroxyl group. In the case of ethoxylated alcohols, R is an aliphatic hydrocarbon radical that is either straight or branched, primary or secondary and may contain from about 8 to about 18 carbon atoms and have an n value from about 2 to about 18. In the case of ethoxylated alkyl phenols, R is an alkyl phenyl radical in which the alkyl group may contain from about 8 to about 15 carbon atoms in either a straight chain or branched chain configuration and have an n value from about 2 to about 18. Examples of such surfactants are listed in U.S. Pat. No. 3,717,630, Booth, issued Feb. 20, 1973, U.S. Pat. No. 3,332,880, Kessler et al, issued Jul. 25, 1967, U.S. Pat. No. 4,284,435, Fox, issued Aug. 18, 1981, which are hereby incorporated by reference. Examples of ethoxylated alkyl phenols also include nonyl phenol condensed with about 9 moles of ethylene oxide per mole of nonyl phenol, and dodecyl phenol condensed with about 8 moles of ethylene oxide per mole of dodecyl phenol. Examples of ethoxylated alcohols include the condensation product of myristyl alcohol condensed with about 9 moles of ethylene oxide per mole of alcohol, and the condensation product of about 7 moles of ethylene oxide with coconut alcohol (a mixture of fatty alcohols with alkyl chains varying in length from 10 to 14 carbon atoms). Examples of commercially available ethoxylated alcohols and alkyl phenols include the following: Tergitol 15-S-9 marketed by Union Carbide Corporation; Neodol 45-9, Neodol 23-6.5, Neodol 45-7 and Neodol 45-4 marketed by Shell Chemical Company; Kyro EOB marketed by The Procter & Gamble Company; Berol® 260 and Berol® 266 marketed by Akzo Nobel; and T-DET® 9.5 marketed by Harcros Chemicals Incorported. A mixture of nonionic surfactants may also be used.

Cationic surfactants may include those containing non-quaternary nitrogen, those containing quaternary nitrogen bases, those containing non-nitrogenous bases and combinations thereof. Such surfactants are disclosed in U.S. Pat. No. 3,457,109, Peist, issued Jul. 22, 1969, U.S. Pat. No. 3,222,201, Boyle, issued Dec. 7, 1965 and U.S. Pat. No. 3,222,213, Clark, issued Dec. 7, 1965, which are hereby incorporated by reference.

One category of cationic surfactants may include quaternary ammonium compounds with the general formula $RXYZ\ N^+A^-$, wherein R is an aliphatic or cycloaliphatic group having from 8 to 20 carbon atoms and X, Y and Z are members selected from the group consisting of alkyl, hydroxylated alkyl, phenyl and benzyl. $A^-$ is a water soluble anion that may include, but is not limited to, a halogen, methosulfate, ethosulfate, sulfate and bisulfate. The R group may be bonded to the quaternary group through hetero atoms or atom groups such as —O—, —COO—, —CON—, —N—, and —S—. Examples of such compounds include, but are not limited to, trimethyl-hexadecyl-ammonium sulfate, diethyl-octadecyl-phenyl-ammonium sulfate, dimethyl-dodecyl-benzyl-ammonium chloride, octadecylamino-ethyl-trimethyl-ammonium bisulfate, stearylamido-ethyl-trimethyl-ammonium methosulfate, dodecyloxy-methyl-trimethyl-ammonium chloride, cocoalkylcarboxyethyl-di-(hydroxyethyl)-methyl-ammonium methosulfate, and combinations thereof.

Another category of cationic surfactants may be of the di-long chain quaternary ammonium type having the general formula $XYRR_1N^+A^-$, wherein X and Y chains may contain an average of from about 12 to about 22 carbon atoms and R and $R_1$ may be hydrogen or $C_1$ to $C_4$ alkyl or hydroxyalkyl groups. Although X and Y may contain long chain alkyl groups, X and Y may also contain hydroxy groups or may contain heteroatoms or other linkages, such as double or triple carbon-carbon bonds, and ester, amide, or ether linkages, as long as each chain falls within the above carbon atom ranges.

An additional category of cationic surfactant may include ethoxylated and bis(ethoxylated) ammonium quaternary compounds.

Synthetic anionic surfactants can be represented by the general formula $R_1SO_3M$ wherein $R_1$ represents a hydrocarbon group selected from the group consisting of straight or branched alkyl radicals containing from about 8 to about 24 carbon atoms and alkyl phenyl radicals containing from about 9 to about 15 carbon atoms in the alkyl group. M is a salt forming cation which typically is selected from the group consisting of sodium, potassium, ammonium, monoalkanolammonium, dialkanolammonium, trialkanolammonium, and magnesium cations and mixtures thereof An example of an anionic surfactant is a water-soluble salt of an alkylbenzene sulfonic acid containing from about 9 to about 15 carbon atoms in the alkyl group. Another synthetic anionic surfactant is a water-soluble salt of an alkyl polyethoxylate ether sulfate wherein the alkyl group contains from about 8 to about 24. Other suitable anionic surfactants are disclosed in U.S. Pat. No. 4,170,565, Flesher et al, issued Oct. 9, 1979, incorporated herein by reference.

Other suitable anionic surfactants can include detergents and fatty acids containing from about 8 to about 24 carbon atoms.

Other useful anionic surfactants include the water-soluble salts, particularly the alkali metal, ammonium and alkylolammonium (e.g., monoethanolammonium or triethanolammonium) salts, of organic sulfuric reaction products having in their molecular structure an alkyl group containing from about 10 to about 20 carbon atoms and a sulfonic acid or sulfuric acid ester group. (Included in the term "alkyl" is the alkyl portion of aryl groups.) Examples of this group of synthetic surfactants are the alkyl sulfates, especially those obtained by sulfating the higher alcohols ($C_8$–$C_{18}$ carbon atoms) such as those produced by reducing the glycerides of tallow or coconut oil; and the alkylbenzene sulfonates in which the alkyl group contains from about 9 to about 15 carbon atoms, in straight chain or branched chain configuration, e.g., those of the type described in U.S. Pat. Nos. 2,220,099 and 2,477,383 both of which are hereby incorporated by reference. Especially valuable are linear straight chain alkylbenzene sulfonates in which the average number of carbon atoms in the alkyl group is from about 11 to 14.

Other anionic surfactants include the water-soluble salts of paraffin sulfonates containing from about 8 to about 24 carbon atoms; alkyl glyceryl ether sulfonates, especially those ethers of $C_{8-18}$ alcohols (e.g., those derived from tallow and coconut oil); alkyl phenol ethylene oxide ether sulfates containing from about 1 to about 4 units of ethylene oxide per molecule and from about 8 to about 12 carbon atoms in the alkyl group; and alkyl ethylene oxide ether sulfates containing about 1 to about 4 units of ethylene oxide per molecule and from about 10 to about 20 carbon atoms in the alkyl group.

Other useful anionic surfactants include the water-soluble salts of esters of alpha-sulfonated fatty acids containing from about 6 to 20 carbon atoms in the fatty acid group and from about 1 to 10 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; water-soluble salts of olefin sulfonates containing from about 12 to 24 carbon atoms; and beta-alkyloxy alkane sulfonates containing from about 1 to 3 carbon atoms in the alkyl group and from about 8 to 20 carbon atoms in the alkane moiety.

Furthermore, other anionic surfactants include $C_{10}$–$C_{18}$ alkyl sulfates and alkyl ethoxy sulfates containing an average of up to about 4 ethylene oxide units per mole of alkyl sulfate, $C_{10}$–$C_{13}$ linear alkylbenzene sulfonates, and mixtures thereof. Unethoxylated alkyl sulfates may also be used.

Chelating agents may form another component of the pre-measured raw chemical material. Chelating agents may soften the feed water, bind insoluble metal ions present in the traffic film, increase surfactant activity and reduce the redeposition of soil. Examples of chelating agents include, but are not limited to, trisodium nitrilotriacetate, trisodium hydroxyethyl ethylene diamine tetraacetate, tetrasodium ethylene diamine tetraacetate, sodium salt of diethanol glycine, and sodium salt of polyacrylic acid.

Additionally, tripolyphosphate and pyrophosphate salts may be used as chelating agents. Tripolyphosphate salts have the general formula $X_5P_3O_{10}$ wherein X is an alkali metal cation. Tripolyphosphate may act as a water softener by sequestering the $Mg^{2+}$ and $Ca^{2+}$ in hard water, and may increase surfactant efficiency by lowering the critical micelle concentration and suspending and peptizing dirt particles. Pyrophosphate salts have the general formula $X_4P_2O_7$ wherein X is an alkali metal cation. Mixtures of chelating agents may also be used.

The particulate raw materials 22 may comprise a variety of powdered silicates, phosphates, surfactants, and combinations thereof. The pre-measured raw chemical material may often comprise a plurality of 50-pound bags of the particulate raw materials 22. More particularly, three bags comprising powdered sodium tripolyphosphate, and a fourth bag comprising sodium metasilicate may be used. Potassium phosphate and sodium carbonate, among other particulate raw materials 22, may also be used.

In one embodiment, the pre-measured raw chemical material may comprise one or more 55-gallon drums 34 filled with liquid raw material 18 (as shown, e.g., in FIGS. 3A and 3B). Alternatively, other size drums (e.g., 30-gallon drums) may be used. The pre-measured raw chemical material can be delivered to facilities on which the on-site mixing apparatus 14 (discussed below) is located. The pre-measured raw chemical material may be positioned on a pallet 39 or a similar supporting mechanism. In one embodiment, the 55-gallon drum 34 may contain a solution comprising an alkaline (e.g., sodium hydroxide) solution, while other drums (e.g., 30-gallon drums, not shown) may contain solutions comprising at least one of a chelant, surfactant, solvent, polymer, stabilizing agent, viscosity control agent, fragrance, dye, and combination thereof. Typically, the 30-gallon drums comprise some type of surfactant. More particularly, in this embodiment, the 30-gallon drums will comprise anionic and nonionic surfactants. The pre-measured raw chemical material may also comprise three bags comprising powdered sodium tripolyphosphate, and a fourth bag comprising sodium metasilicate. Potassium phosphate and sodium carbonate, among other particulate raw materials 22, may also be used.

In another embodiment, a pre-measured raw chemical material comprises three 50 pound bags of sodium tripolyphosphate, one 50 pound bag of sodium metasilicate, 49 gallons of a liquid surfactant blend, 11 gallons of liquid EDTA and 30 gallons of liquid 50% NaOH. The surfactant blend comprises anionic and nonionic surfactants. This mixture should be subsequently mixed using the apparatuses and methods discussed in more detail below. To ensure stability, the pre-measured raw chemical material should be mixed in a particular order. More particularly, the particulate materials comprising the three 50 pound bags of sodium tripolyphosphate and one 50 pound bag of sodium metasilicate should first be dumped or spilled into a mixing tank 50 (see FIG. 2), and then the 49 gallons of surfactants mixed therewith. Subsequently, the caustic solution and the EDTA may be mixed, in any order.

The pre-measured raw chemical material will vary from application to application, and may depend largely on the needs of the independent end users or car washes as discussed in more detail below. Appropriate mixtures of liquid raw materials 18 and particulate raw materials 22 will depend on the application, but can be readily formulated by those having skill in the art.

The raw material platform 30 enables a fork lift or other such transporter to deliver the liquid and particulate raw materials 18, 22. The raw material platform 30 may be separate from the remaining portions of the apparatus 14, such that the platform 30 is movable relative to the remaining portions of the apparatus 14. The raw material platform 30 of FIGS. 2–3B includes grating 40 to support thereon the raw materials 18, 22. The grating 40 allows spilled raw materials 18, 22 to pass therethrough, such that the spilled raw materials 18, 22 are collected in the bottom of the platform 30 for later retrieval and disposal. In other words, the platform 30 provides spill control and containment of the raw materials 18, 22.

The platform 30 includes a singular swivelable pickup wand 46. Alternatively, the platform may include a plurality of swivelable pickup wands 46. Generally, the pickup wand 46 is swivelable and movable over a wide area of the platform 30, such that the pickup wand 46 is positionable over the drums 34 and insertable into one of the drums 34. The wand 46 may be movable laterally and/or vertically.

In the platform 30 of FIGS. 2–3B, the singular swivelable pickup wand 46 is inserted into one drum 34 at a time to pump the liquid raw material therefrom 18. The swivelability of the wand 46 allows for the drums 34 to remain stationary after being delivered. A pump 54 and a series of valves 58, 62, 66, 70, 74, and 78 (shown schematically in FIG. 1) pump the liquid raw material 18 from each drum 34 and into the mixing tank 50. In this construction of the raw material platform 30, the drums 34 of liquid raw materials 18 are pumped into the mixing tank 50 separately and sequentially. After finishing with a particular drum 34, the pickup wand 46 is removed upwardly from that drum 34, swiveled, and inserted downwardly into another drum 34 of liquid raw material 18.

Alternatively, in a construction of the platform 30 utilizing a plurality of swivelable pickup wands 46, the plurality of wands 46 are inserted into a respective plurality of drums 34 of liquid raw materials 18 to pump the liquid raw materials 18 therefrom. Multiple pumps (one for each wand, not shown) and valves (not shown) pump the liquid raw materials 18 from the drums 34 into the mixing tank 50. The multiple drums 34 of liquid raw materials 18 may be pumped into the mixing tank 50 sequentially, concurrently, or a combination thereof.

The fluid connection between the pickup wand 46 and the mixing tank 50 is schematically illustrated in FIG. 1. A diaphragm pump 54 (see FIG. 1) may be used to pump the liquid raw materials 18 from the drums 34. Such a diaphragm pump 54 is manufactured by Graco Inc. of Minneapolis, Minn., under Part No. D72911, Husky 1040-Acetal-Polypropylene-Kynar-and Plus Series. However, other pumps, such as centrifugal pumps and reciprocating piston pumps, among others, may be used in place of the diaphragm pump 54. Also, air-operated ball valves (58, 62, 66, 70, 74, and 78 in FIG. 1) control the flow of liquid raw materials 18 from the drums 34 to the mixing tank 50. Such air-operated ball valves are manufactured by Plast-O-Matic Valves Inc. of Cedar Grove, N.J., under Part Nos. BVS075VT-PV, BVS050VT-PV, BVS100VT-PV, and BRS150VT-PV-LS. In one embodiment, the valves 58, 62, and 66 may be 1.5-inch air-operated ball valves, while valves 70, 74, and 78 may be 1-inch air-operated ball valves.

The air-operated ball valves 58, 62, 66, 70, 74, and 78 receive their air supply from a source of compressed air (not shown), such as an air compressor. A conventional 5-hp air compressor having an 80-gallon tank is sufficient for use with the apparatus 14. Alternatively, other types of valves, e.g., diaphragm valves, angle seat valves, bobbit vavles, butterfly valves, direct lift valves, and proportioning valves, may be used in place of the ball valves 58, 62, 66, 70, 74, and 78. Other methods of actuating the valves, such as electrical actuation, hydraulic actuation, or manual actuation, among others, may be used in place of the pneumatic actuation.

In the platform 30 of FIGS. 3A–3B, the pickup wand 46 is supported by a post 102 configured as an air cylinder. The post 102 includes a base housing 106 coupled to the platform 30 and a rod 110 for extending and retracting the wand 46 relative to the housing 106. An air valve (not shown) receives air (or another suitable compressed gas) from the source of compressed air, and diverts the air to the appropriate side of the rod 110 to actuate the rod 110. An intermediate L-shaped support arm 118 is rotatably coupled to the rod 110, and a swiveling support arm 122 is rotatably coupled to the intermediate support arm 118. The rotating intermediate support arm 118, in combination with the swiveling support arm 122, provides multiple degrees of freedom to the pickup wand 46.

Alternatively, the wand 46 may be supported by a post (not shown) having an adjustable intermediate support arm (not shown). The intermediate support arm may be coupled for movement along the posts. A series of opposing rollers (not shown) may pinch opposing surfaces of the posts to secure the intermediate support arm to the posts and provide smooth upward and downward adjustment of the intermediate support arm along the posts. The intermediate support arm may be coupled to an adjusting mechanism allowing a vertical adjustment of the intermediate support arm. Further, one or more swiveling support arms (not shown) may be rotatably coupled to the intermediate support arm to provide swiveling movement to the wand 46. The swiveling support arms may provide one degree of freedom to the pickup wand 46.

The pickup wand 46 includes a tubular portion 130 that is insertable into the drums 34, and a coupling portion 138 for fluid connection to a conduit 142. The tubular portion 130 is slidably coupled to the swiveling support arm 122 and is vertically adjustable relative to the swiveling support arm 122. An operator may insert the tubular portion 130 into the drums 34 until the lower end 145 of the tubular portion 130 is close to or abuts the bottom surface of the drums 34. To ensure a majority of the liquid raw materials 18 is emptied from the drums 34, slots (not shown) may be formed at the lower end 145 of the tubular portion 130, such that a seal is not formed by the abutment of the lower end 145 of the tubular portion 130 and the bottom surface of the drums 34. The subsequent openings defined by the slots and the bottom surface of the drums 34 allow the liquid raw materials 18 to be drawn into the tubular portion 130 and pumped from the drums 34. Alternatively, the lower end 145 of the tubular portion 130 may include a series of apertures (not shown) therethrough to allow the liquid raw materials 18 to be drawn into the tubular portion 130 and pumped from the drums 34.

The pickup wand 46 also includes a rinsing cap 150 slidably adjustable along the tubular portion 130 of the wand 46 and insertable into the drums 34. The rinsing cap 150 may act to seal, at least in part, the drums 34 when the wand 46 is inserted therein. The rinsing cap 150 is fluidly connected with a source of water (or other diluting liquid) via conduits 154, 374 to rinse the drums 34, as well as the wand 46, with water after the liquid raw material 18 is substantially pumped from the drums 34. In one embodiment, substantially the entire drum 34 may be filled with a diluent or a rinse solution containing residual amounts of liquid raw materials 18, which may or may not then be pumped into the mixing tank 50. This rinsing feature alleviates unnecessary exposure to the liquid raw materials 18. As shown schematically in FIG. 1, a dedicated water pump 158, in combination with ball valve 70, ball valve 162, and check valve 166 provide the rinsing water to the drums 34. A centrifugal pump may be utilized to pump the water from the water source. Such a water pump 158 is available from Huron Valley Sales of Dearborn, Mich., under Part No. PROPACK SRF. However, other pumps, such as those manufactured by Stayrite, Gould, Meyers, and Grundfoss may also be used. Further, the ball valve 162 may be a ½-inch air-operated ball valve.

Figure 5:
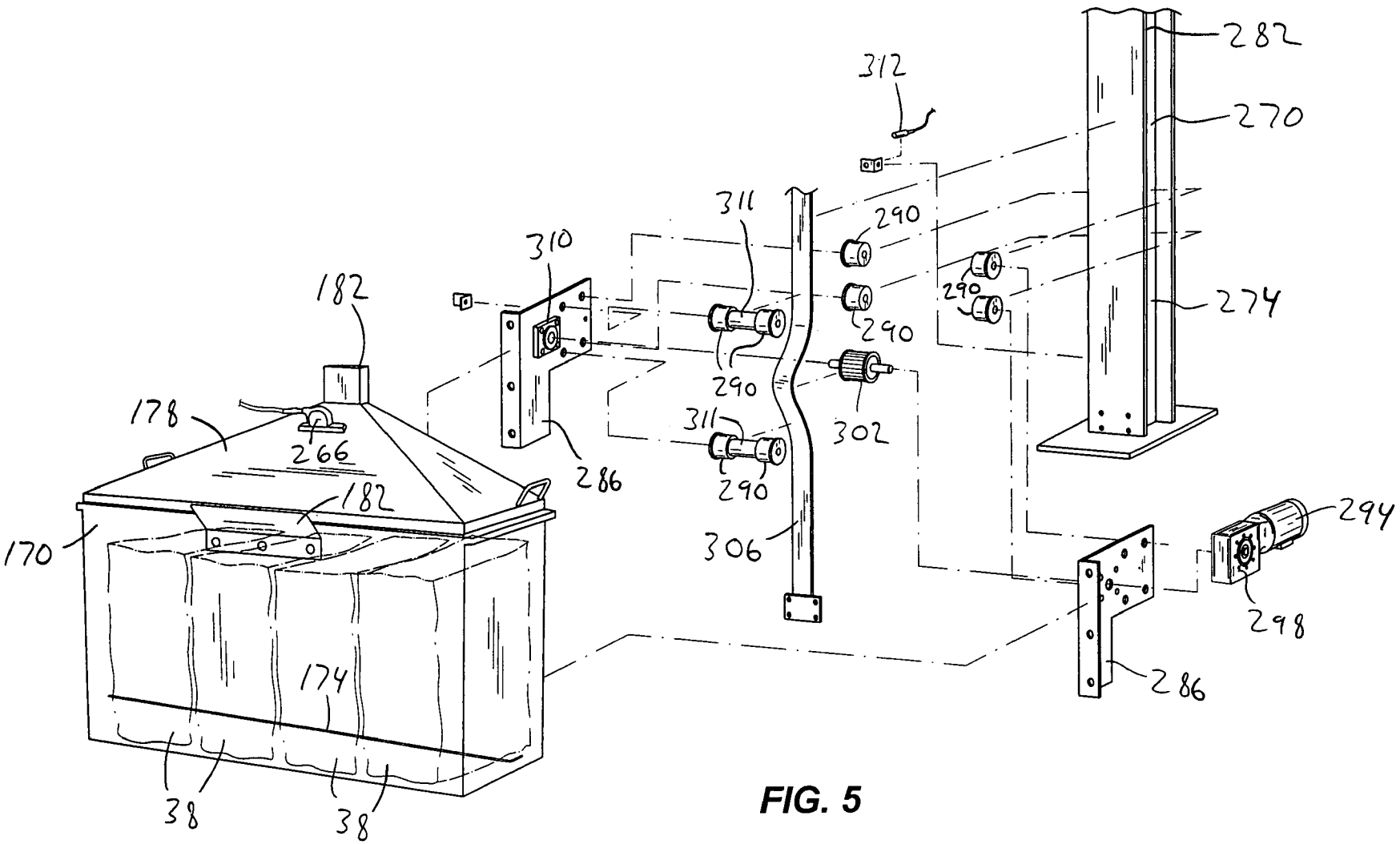
FIG. 5 is an exploded view of a drive mechanism that is operable to move the container of FIG. 4 between the lowered and substantially inverted positions.

The particulate raw materials 22 may be mixed concurrently with or separately from the liquid raw materials 18. As shown in FIG. 5, the packages 38 of particulate raw materials 22 are placed in a container 170 and secured therein by passing a spear or rod 174 therethrough. In other words, the rod 174 spears each of the packages 38 so that they are secure upon being inverted. Also, the top portions of the packages 38 are removed to expose the particulate raw materials 22. The container 170 includes a tapered lid 178 coupled thereto by a hinge connection 186 on one side of the tapered lid 178, and latches (not shown) on the opposite side of the tapered lid 178 to secure the tapered lid 178 when it is closed. The tapered lid 178 allows the particulate raw materials 22 to spill from their packages 38 through an opening 182 in the tapered lid 178 when the container 170 is inverted. The opening 182 is sized appropriately to meter the amount of particulate raw material 22 that spills from the container 170. It may be desirable to meter the amount of particulate raw material 22 spilling into the mixing tank 50 so that the particulate raw material 22 is added in proportion to the liquid raw material 18, and that insoluble amounts of particulate raw material 22 are substantially prevented from spilling into the tank 50. The opening 182 may or may not be offset from the center of the tapered lid 178.

Generally, an inverter 198 (see FIG. 4) inverts the container 170 to dump or spill the particulate raw materials 22 into the mixing tank 50 to mix with the liquid raw materials 18 and/or the water diluent. The inverter 198 allows the operator of the mixing apparatus 14 to spill the particulate raw materials 22 into the mixing tank 50 without being exposed to the dust created when the particulate raw materials 22 spill out into the mixing tank 50.

Figure 4:
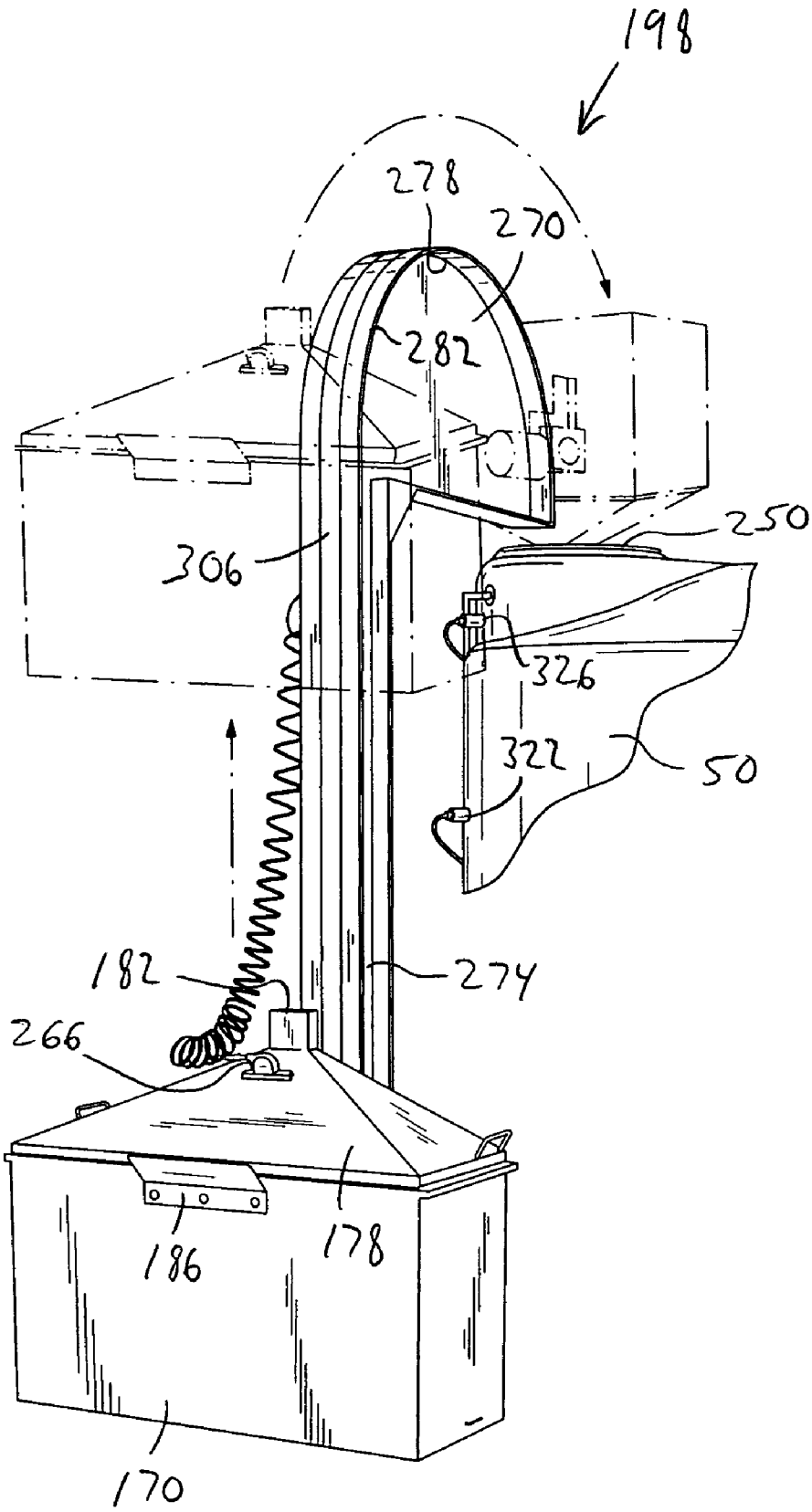
FIG. 4 is a front perspective view of an inverter and a mixing tank of the automated mixing apparatus of FIG. 1, illustrating a container being raised from a lowered position to a substantially inverted position.

One construction of the inverter 198 is shown in FIGS. 4–5. The main structure of the inverter 198 is a frame 270 having a substantially vertical lower portion 274 and an arcuate upper portion 278. The outer perimeter of the frame 270 is defined by a lip 282 following the contours of the vertical lower portion 274 and the arcuate upper portion 278. The container 170 is supported on the frame 270 by a bracket 286 including a series of rollers 290, which are configured on the bracket 286 to pinch the lip 282 and, accordingly, secure the container 170 thereto. The rollers 290 also allow the container 170 to roll along the lip 282 to different positions of the lip 282. The inverter 198 also includes an electric motor 294 and a gearbox 298 coupled to the bracket 286, such that the electric motor 294 and gearbox 298 are movable with the bracket 286 along the lip 282. The electric motor 294 and gearbox 298 drive a cog 302, which drivingly engages a ribbed belt 306 affixed to the lip 282 along the lower portion 274 and upper portion 278 of the frame 270. The cog 302 is supported within the bracket 286 by flange-mounted bearings 310, and sufficient belt wrap is maintained on the cog 302 by belt rollers 311 in contact with the belt 306. Upon activation of the motor 294, the cog 302 rotates to "climb" the belt 306 to move the container 170, together with the electric motor 294 and gearbox 298, along the lip 282 of the frame 270.

The electric motor 294 may be a ½-hp motor operating at about 1750 RPM. The gearbox 298 may be configured with a 100:1 speed reduction, such that the cog 302 is driven at about 17 RPM. However, any reasonable size electric motor 294 and gearbox 298 may be used to drive the cog 302, provided the necessary amount of torque required to overcome the combined weight of the filled container 170, bracket 286, electric motor 294, and gearbox 298 is transmitted to the cog 302.

The container 170 is movable between its lowered position and its substantially inverted position upon activation of the motor 294 to drive the cog 302 (see FIG. 4). Proximity sensors 312, such as those manufactured by Square D of Palatine, Ill., under Part No. SQDXS1M18MA370D, can be mounted on the frame 270 in locations corresponding with the lowered position and the inverted position of the container 170, respectively. Only the sensor 312 corresponding with the lowered position of the container 170 is shown in FIG. 5. The sensors 312 are operable to detect the presence or absence of the container 170. FIG. 4 illustrates a sequence in which the container 170 is raised from its lowered position to its substantially inverted position. The inverter 198 is configured to move the container 170 between its lowered and inverted positions in a time period of about 30 seconds to about 3 minutes, and more particularly, about one minute. Upon reaching the substantially inverted position, the tapered lid 178 funnels the particulate raw materials 22 in the container 170 through the opening 182 in the tapered lid 178, and through an opening 250 in the top of the mixing tank 50.

When the particulate raw materials 22 are not being loaded into the tank 50, a lid (not shown) may cover the opening 250 to substantially prevent any vapor or liquid from leaking or splashing out of the tank 50. An agitator 258 (see FIG. 6) is coupled to the mixing tank 50 to stir the contents of the mixing tank 50 during loading of the liquid and particulate raw materials 18, 22. The agitator 258 is driven via a direct drive connection with an electric motor 262 operating at about 1725 RPM. However, a larger agitator (not shown) may be used in combination with the electric motor 262 and another speed-reducing gearbox (not shown) to stir the contents of the mixing tank 50.

Also, the apparatus 14 may comprise a vibration device 266 that is coupled to the tapered lid 178 of the container 170 to help shake the particulate raw material 22 out of the container 170. The vibration device 266 may be a ball-pneumatic vibrator, such as the ball-pneumatic vibrator Part No. V-130 manufactured by Vibco, Inc. of Wyoming, R.I. However, the vibration device 266 may also be electrically or hydraulically operated, among other methods of operation. The vibration device 266 receives its air supply from the same source of compressed air as the air-operated ball valves 58, 62, 66, 70, 74, 78, and 162.

FIGS. 4–5 illustrate an exemplary inverter 198. However, alternative constructions of the inverter 198 may be utilized. For example, the container 170 may be coupled to parallel chain loops (not shown) configured on the frame 270 using a series of idler sprockets and driven sprockets (not shown). The driven sprockets may be coupled to an electric motor and a gearbox similar to those discussed with reference to the illustrated construction of the inverter 198. The container 170 may be movable between its lowered position and its substantially inverted position upon activation of the motor to drive the chain loops.

The mixing tank 50 (see FIG. 6) is sized to hold at least about 100 gallons, and may hold up to 1050 gallons. In one embodiment, the mixing tank 50 may hold up to about 990 gallons of detergent solution. The mixing tank 50 may be employed in the apparatus 14 of FIG. 2. The mixing tank 50 may be made from plastic, such as linear polyethylene (Linear), crosslinkable polyethylene (XPLE), or polypropylene (PP). One particular example is manufactured by CHEM-TAINER Industries of West Babylon, N.Y., under Part No. TN7285JP. The mixing tank 50 includes a tapered bottom surface 314 having an aperture 318 formed therein. The liquid raw materials 18 pumped into the mixing tank 50 and the water pumped into the mixing tank 50 enter the tank 50 via the aperture 318 formed in the bottom surface 314 of the tank 50. In other words, these substances are pumped into the tank 50 from the bottom of the tank 50. Also, once the substances are present in the mixing tank 50, and mixed into a mixture, the mixture is pumped from the tank 50 through the same aperture 318 formed in the bottom surface 314 of the tank 50. In other words, the mixture is also pumped from the tank 50 from the bottom of the tank 50.

Further, multiple sensors 322, 326 are utilized to detect the fill level of the mixing tank 50 (described in more detail below).

Figure 6:
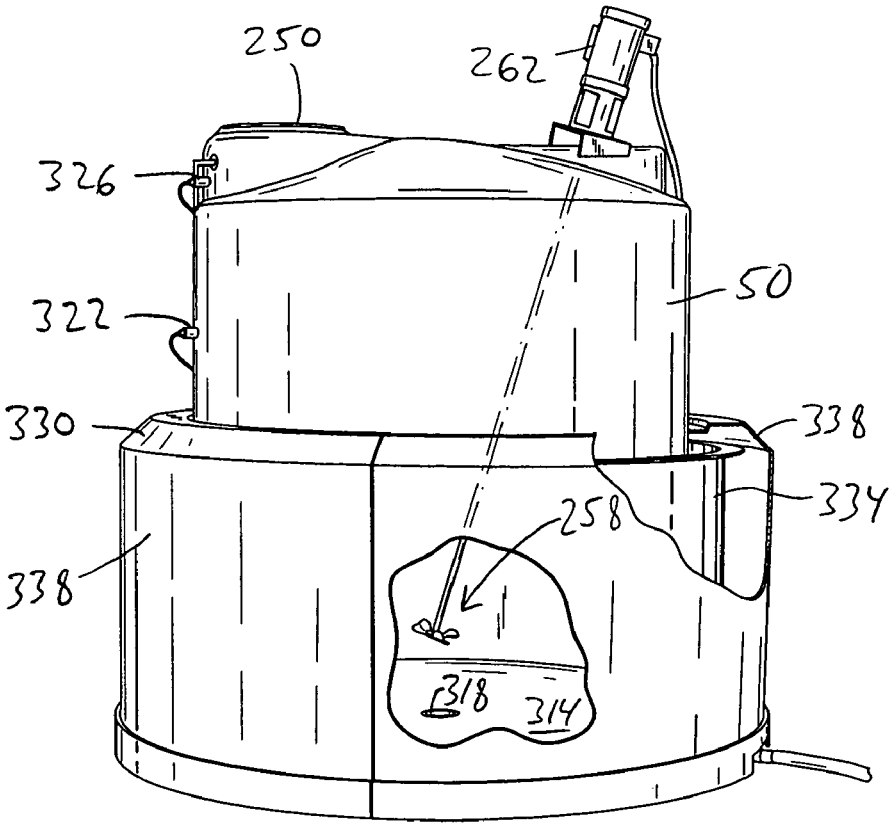
FIG. 6 is a partial cutaway, perspective view of the mixing tank of the automated mixing apparatus of FIG. 1, illustrating an interior view of the mixing tank, multiple sensors mounted to the mixing tank, and an outer tank assembly around the mixing tank.

With continued reference to FIG. 6, an outer tank assembly 330 encloses the bottom portion of the mixing tank 50 for total spill containment. The outer tank assembly 330 includes an outer tank 334 and multiple cover modules 338 covering the outer tank 334. The outer tank 334 is fluidly sealed, such that any spilled or leaked detergent solution or raw materials 18, 22 from the mixing tank 50 will be contained by the outer tank 334. The outer tank 334 may be formed from fiberglass, or may be formed by rotationally molding, vacuum molding, or injection molding plastics such as, linear polyethylene (Linear), crosslinkable polyethylene (XLPE), or polypropylene (PP) as a singular piece. This construction of the outer tank 334 helps contain leakage or spillage from the mixing tank 50 within the outer tank 334. The cover modules 338 fasten to the outer tank 334 in order to protect the outer tank 334 from accidental contact with any object capable of damaging the fiberglass structure of the outer tank 334. The outer tank 334 may also be made from stainless steel, aluminum, or sheet metal with a corrosion-resistant finish.

After the mixture is established in the mixing tank 50, it is pumped out of the mixing tank 50 via the aperture 318 formed in the bottom surface 314 of the mixing tank 50 by yet another pump 342 through conduit 370, through valve 58, through conduit 142, through valve 78, through the diaphragm pump 342, through valves 346, 350, and into multiple drums 402 (see FIGS. 3A and 3B) for transport to the car washes (schematically illustrated in FIG. 1). In the apparatus 14, a diaphragm pump 342 is used to pump the detergent solution from the mixing tank 50 into multiple drums for transport to the car washes. Such a diaphragm pump 342 is manufactured by Graco Inc. of Minneapolis, Minn., under Part No. D72911, Husky 1040-Acetal-Polypropylene-Kynar-and Plus Series. However, another pump, such as a centrifugal pump or a reciprocating piston pump, among others, may be used in place of the diaphragm pump 342. Also, air-operated ball valves 58, 78, 346, and 350 control the flow of detergent solution from the mixing tank 50 to the drums. Such air-operated ball valves are manufactured by Plast-O-Matic Valves Inc. of Cedar Grove, N.J., under Part Nos. BVS075VT-PV, BVS050VT-PV, BVS100VT-PV, and BRS150VT-PV-LS. The ball valves 346, 350 maybe ¾-inch air-operated ball valves. The air-operated ball valves 346, 350 receive their air supply from the same source of compressed air as the other air-operated ball valves 58, 62, 66, 70, 74, 78, and 162 and the vibration device 266. Alternatively, other types of valves may be used in place of the ball valves, and other methods of actuating the valves, such as electrical actuation, hydraulic actuation, or manual actuation, among others, may be used in place of the pneumatic actuation.

With reference to FIGS. 3A and 3B, fill wands 354 are inserted into the drums 402 to fill the drums 402 with the mixture from the mixing tank 50. Although only two fill wands 354 are shown in FIGS. 3A and 3B, a single fill wand 354, or more than two fill wands 354 may be utilized in the apparatus 14. The fill wands 354 are fluidly connected to the diaphragm pump 342 through respective air-operated ball valves 346, 350 in a parallel configuration (see FIG. 1). Also, the outlet of the diaphragm pump 342 is fluidly connected with an accumulator 358 to dampen the fluid pulses through the detergent solution exiting the diaphragm pump 342, which are generated by the operation of the diaphragm pump 342. The fill wands 354 may include fill level sensors (not shown) which control the filling of the drums, such that once a pre-determined fill level of detergent solution is reached in a particular drum, the associated sensor triggers the air-operated ball valve 346 or 350 associated with that particular fill wand 354 closed. Manual operation of the air-operated ball valves 58, 78, 346, and 350 is also possible, in such cases where it is desired to "top-off" the fill level of the drums. It should also be known that the air-operated ball valves 58, 62, 66, 70, 74, 78, 162, 346, and 350 are biased toward a closed position, such that in case of failure of any of the valves 58, 62, 66, 70, 74, 78, 162, 346, and 350, the failed valve remains closed to substantially prevent unwanted flows.

The entire process, from delivering the raw materials 18, 22 to the mixing tank 50, to pumping the detergent solution into transportable drums 402, may be automated by a controller 406, such that little human interaction is required. Such a controller 406 may be manufactured by Siemens AG Automation and Drives Industrial Automation Systems of Nuremberg, Germany, under Part Nos. SIMATIC S7-200, CPU 226/CPU 226XM, and EM241. A computer 408 or a computer network may also interface with the controller 406 to provide instructions to the controller 406. The computer 408 may be integral with a touch screen 416 (see FIG. 7), which is in communication with the controller 406. The computer 408 may also download data stored by the controller 406 relating to the mixing process. The diaphragm pumps 54, 342 and ball valves 58, 62, 66, 70, 74, 78, 162, 346, and 350 are air-operated, such that their operation is triggered by the controller based on input from the sensors 322, 326 in the mixing tank 50 and the sensors in the fill wands 354. Also, the electric motors 294, 262 powering the inverter 198 and agitator 258, respectively, are also activated and deactivated by the controller 406.

Figure 7:
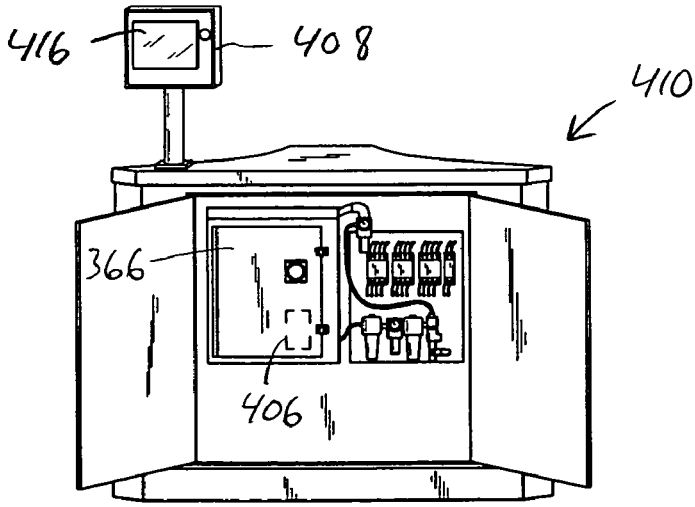
FIG. 7 is a front perspective view of a control box housing a controller, the control box being housed in a cabinet of the automated mixing apparatus of FIG. 1.

As shown in FIG. 7, the controller 406 is housed in a control box 366, which is positioned in a cabinet 410 adjacent the mixing tank 50 (see also FIG. 2). An operator may provide input to the controller 406, and the operator may view various operating parameters of the apparatus 14 via the touch screen 416. Alternatively, the operator may provide input to the controller 406 via a push-button keypad with or without a display panel.

With reference to the fluid schematic of FIG. 1, the process by which the raw materials 18, 22 are mixed into the mixing tank 50 to establish the mixture (e.g., a detergent solution), and the process by which the detergent solution is pumped from the mixing tank 50 into individual transportable drums will be described. These processes will be described with regard to the illustrated mixing apparatus 14, which incorporates only a singular pickup wand 46. However, the processes are substantially similar when a plurality of pickup wands 46 are utilized.

In preparation of mixing the raw materials 18, 22 into the mixing tank 50, the raw materials 18, 22 are positioned in an appropriate location relative to the apparatus 14 on the platform 30. A fork lift or similar transport vehicle may be used to transport the raw materials 18, 22 onto the platform 30. To facilitate transport of the raw materials 18, 22, the raw materials 18, 22 may be pre-packaged and shrink-wrapped on the pallet 39.

The supplier of the pre-measured raw chemical material may supply the distributor with one or more "mixing codes" that are specific to the particular pre-measured raw chemical material delivered to the distributor on the pallet 39. For example, a single mixing code may be provided for each pallet 39 of pre-measured raw chemical material. In some embodiments, validation of the mixing code enables functioning of the mixing apparatus 14, as described below.

Figure 8:
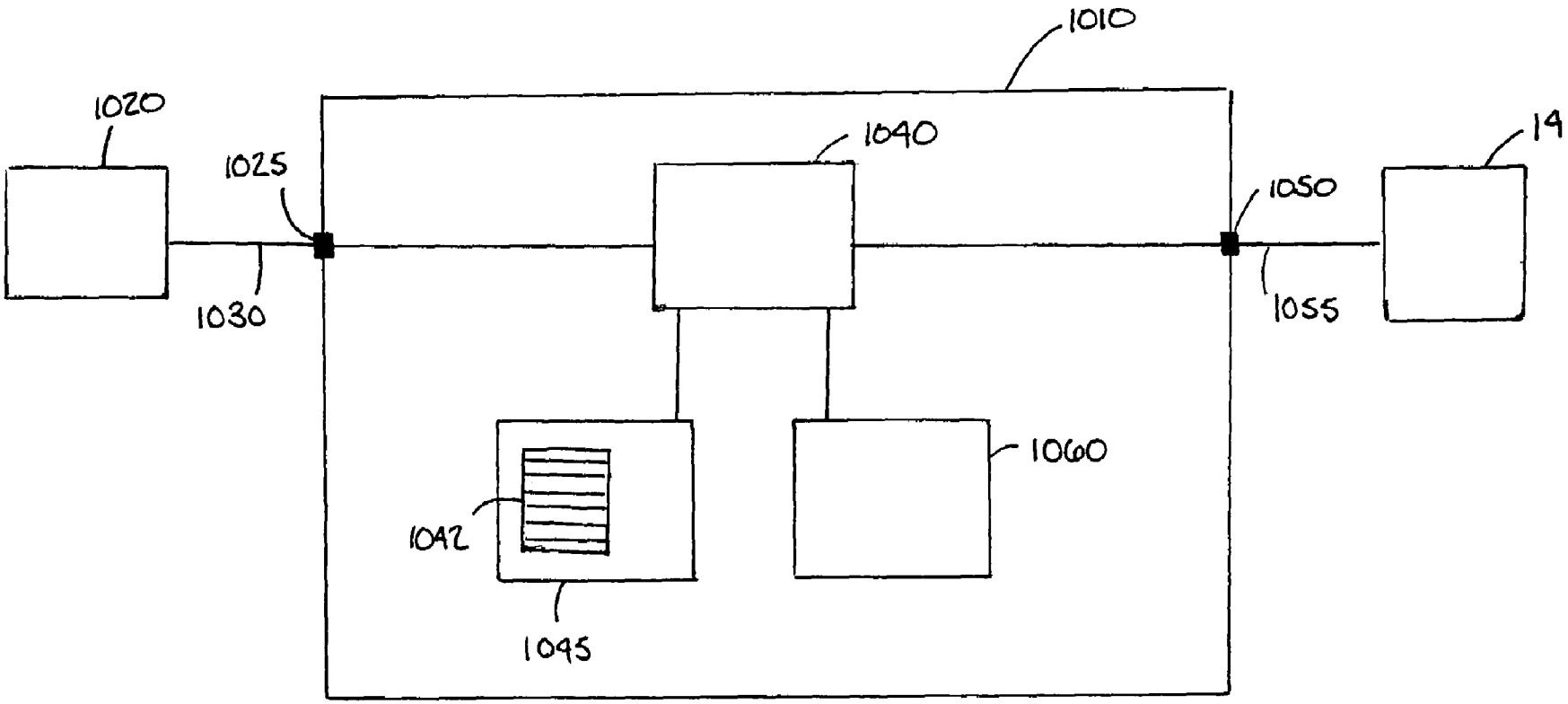
FIG. 8 is a schematic diagram of a validation controller.

FIG. 8 illustrates a validation controller 1010 that validates the mixing code. In one embodiment, the mixing code can include a sequence of numbers, alphanumeric characters, symbols, dedicated buttons or switches, or a combination thereof that a user manually enters into an input device 1020. For example, the input device 1020 can include a touch screen 416 (shown in FIG. 7), a computer keyboard (not shown) or the like. In other embodiments, the mixing code can be generated from an identification device, such as, for example, a card or identification badge having a bar code, an optical code, a transponder, a transmitter or the like. In these embodiments, the input device 1020 can include a bar code reader (not shown), an optical code reader, a receiver (not shown), an interrogation device or a similar device.

Referring to FIG. 8, a user can enter the mixing code into the input device 1020. The input device 1020 generates a signal which includes the un-validated mixing code. The signal is sent to the input port 1025 of the validation controller 1010 via a link 1030. In some embodiments, the validation controller 1010 can be included in the apparatus 14. In these embodiments, the link 1030 can include a cable, a hardwired connection, a wireless link or another similar connection. In other embodiments, the validation controller 1010 can be included at a remote site, such as, for example, a computer on the supplier's network (not shown). In these embodiments, the link 1030 can include a secured or unsecured communication link capable of connecting the input device 1020 to the remote network, as is known in the art. For example, the input device 1020 can include a modem (not shown) that establishes a connection to the validation controller 1010 via a telephone line (not shown).

Still referring to FIG. 8, the input port 1025 receives the signal (including the mixing code) and sends the signal to a processor 1040. In the illustrated embodiment, the processor 1040 can validate the mixing code by comparing the mixing code to a validation code. In one embodiment, the processor 1040 validates the mixing code by comparing the code to a table 1042 of validation codes stored in memory 1045. If the mixing code matches a validation code stored in the table 1042, then the mixing code is validated. If the mixing code does not match any validation codes stored in the table 1042, then the mixing code is not validated.

In other embodiments, the processor 1040 may validate the mixing code by comparing the code to a validation code generated by a code generation module 1060 instead of a preprogrammed table 1042 stored in memory 1045. In these embodiments, the mixing code may include a key within the mixing code itself. The processor 1040 may parse the mixing code for the key and input the key into the code generation module 1060 in order to generate the validation code.

In further embodiments, the mixing code may include the validation code within the mixing code itself. In these embodiments, the processor 1040 may parse the mixing code for the validation code and compare the validation code to the mixing code.

When the mixing code is validated, the validation controller 1010 sends an enabling control signal from the output port 1050 of the validation controller 1010 to the mixing apparatus 14 via a link 1055. The enabling control signal enables functioning of the mixing apparatus 14. The link 1055 can be the same or similar link as the link 1030 connecting the input device 1020 to the validation controller 1010. In other embodiments, the enabling control signal can further include operating instructions for the mixing apparatus 14.

When the mixing code is not validated, the validation controller 1010 sends a disabling control signal from the output port 1050 to the mixing apparatus 14 via the link 1055. The disabling control signal prohibits functioning of the mixing apparatus 14.

In an exemplary implementation, for example, an operator inputs the mixing code by a touch screen 416. The computer 408 of the apparatus 14 may then access the computer network of the supplier of the pre-measured raw chemical material to validate the mixing code. If the mixing code is valid, a signal is sent to the computer 408 of the apparatus 14 confirming the validity of the mixing code. The apparatus 14 is then cleared to dilute the pre-measured raw chemical material as discussed below. However, if the mixing code is not valid, operation of the mixing apparatus 14 is not allowed.

In the embodiments shown in the figures, a single drum 34 of liquid raw materials 18 and four packages 38 of particulate raw materials 22 are used. Of course, the number, size and amounts of the liquid and particulate raw materials 18, 22 may vary. Also, the drums 34 of liquid raw materials 18 may be positioned on the raw material platform 30, such that they are supported by the grating 40 in the platform 30.

The tubular portion 130 of the pickup wand 46 is then inserted into one of the drums 34 of liquid raw materials 18, along with the rinsing cap 150 (see FIG. 3B). In one embodiment, the wand 46 may be inserted into a 55-gallon drum of a caustic solution. Again, the order in which the liquid raw materials 18 are pumped into the mixing tank 50 may vary. Also, the packages 38 of particulate raw materials 22 are inserted into the container 170, and the rod 174 is stabbed through the packages 38 to secure them in the container 170. Further, the upper portions of the packages 38 are removed (by cutting, tearing, or any other suitable method), and the tapered lid 178 is closed and latched in place.

To provide the base for the detergent solution, the mixing tank 50 is initially flooded with a diluent, such as water, RO water, soft water, or DI water (i.e., de-ionized water). To accomplish this, the controller triggers the air-operated ball valves 62, 66, 74, 78, and 162 closed and the valves 58, 70 open. Valves 62, 66 remain closed throughout the process of producing the mixture and the process of pumping the mixture into the drums 402. Also, the controller activates the water pump 158 to generate a flow and water pressure through conduit 154. The check valve 166 is biased against the flow of the water supplied by the water pump 158, however, the water pressure is sufficient enough to overcome the bias in the check valve 166. Further, the water is allowed to flow through the check valve 166, through valve 70, through conduit 142, through valve 58, through conduit 370, and into the mixing tank 50 through the aperture 318 formed in the bottom surface 314 of the mixing tank 50. As such, conduits 154, 142, 370 effectively define a passageway between the water pump 158 and the tank 50. Water is allowed to accumulate in the tank 50 until the fill level coincides with the location of sensor 322 (see FIG. 6) on the mixing tank 50, whereby the controller 406 receives a signal from the sensor 322 to deactivate the water pump 158 and close valve 70 once the sensor 322 detects the fill level of the mixing tank 50. Less than about 650 gallons or 700 gallons of water accumulate in the mixing tank 50 before the sensor 322 signals the controller 406 to trigger valve 70 closed and deactivate the water pump 158. The proportions of the tank 50, components, and materials 18, 22 can all be easily changed by one of ordinary skill in the art.

While the mixing tank 50 is being filled with about 650 gallons of water, the operator loads the container 170 with the bags of particulate raw material 22. Once the tank 50 is filled with the water, the controller 406 triggers the motor 262 on to power the agitator 258 to begin stirring the water in the tank 50. The controller may then activate the electric motor 294 in the inverter 198 in a first direction to raise the container 170. The controller deactivates the electric motor 294 once a signal is received from the inverted position sensor on the inverter 198, which detects the container 170 when it reaches its inverted position. Once inverted, the container 170 spills the particulate raw materials 22 into the mixing tank 50 through the opening 250 in the top of the mixing tank 50.

The controller 406 allows about 2–3 minutes between deactivating the electric motor 294 of the inverter 198 and activating the vibration device 266 to shake any remaining particulate raw materials 22 into the tank 50. The controller 406 triggers an air valve (not shown) open to fluidly connect the vibration device 170 with the source of compressed air. The vibration device 170 then "shakes" the tapered lid 178 of the container 170 to help ensure that a majority of the particulate raw materials 22 in the container 170 spill out of the container 170 and into the mixing tank 50. After about 30-seconds of shaking, the controller 406 triggers the air valve closed to deactivate the vibration device 266. Then, after the vibration device 266 is deactivated, the controller 406 re-activates the motor 294 in the inverter 198 in an opposite direction to lower the container 170 from its inverted position to its initial lower position. Another sensor 312 on the inverter 198 detects the container 170 upon reaching the lowered position, thus signaling the controller 406 to deactivate the electric motor 294 of the inverter 198.

As previously mentioned, while the particulate raw material 22 is being loaded into the mixing tank 50, the agitator 258 is activated to stir the water and particulate raw material 22 to cause the particulate raw material 22 to dissolve into solution with the water in the mixing tank 50. At any point before, during, or after subsequent loading of the liquid raw material 18 into the mixing tank 50, the controller 406 may activate the electric motor 262 to drive the agitator 258 and stir the solution. The controller 406 may be programmed to continually operate the agitator 258, or intermittently operate the agitator 258 based on a pre-determined or random schedule. Also, the controller 406 may be programmed to operate the agitator 258 and stir the solution for any desired period of time.

After the particulate raw material 22 is mixed into the tank 50, the liquid raw material 18 is pumped into the tank 50. For this to occur, the controller 406 triggers valves 58, 74 open, while valves 62, 66, 70, and 78 remain closed. Also, diaphragm pump 54 is activated to begin pumping the liquid raw material 18 from the first drum 34 containing the pickup wand 46. The liquid raw material 18 is pumped out of the drum 34 by the diaphragm pump 54, the liquid raw material 18 then flows through valve 74, through conduit 142, through valve 58, through conduit 370, and into the mixing tank 50 through the aperture 318 formed in the bottom surface 314 of the mixing tank 50. Once the particular drum 34 is emptied of its liquid raw material 18, the operator manually triggers the controller 406 to close valves 58, 74 and deactivate the diaphragm pump 54. Alternatively, the pickup wand 46 may include a low-level sensor (not shown) to detect a low level of liquid raw material 18 remaining in a drum 34 and signal the controller 406 to trigger valves 58, 74 closed and deactivate the diaphragm pump 54 once the level of liquid raw material 18 in the drum 34 is sufficiently low.

The first drum 34 is then rinsed with water from the water pump 158 through the rinsing cap 150. To accomplish this, the controller 406 triggers valve 162 open and activates the water pump 158 to provide water through conduit 154, which is diverted through conduit 374 to the rinsing cap 150. Water is allowed to accumulate in the emptied drum 34 to dilute any leftover or residual liquid raw material 18 in the drum 34, while also rinsing the wand 46. Upon filling the drum 34 with water, the operator may manually signal the controller to trigger valve 162 closed and deactivate the water pump 158.

The operator may or may not then manually signal the controller to trigger valves 58, 74 open and activate diaphragm pump 54 to pump the diluted liquid raw material or rinse solution from the drum 34, which is almost entirely diluent, through valve 74, through conduit 142, through valve 58, through conduit 370, and into the mixing tank 50 through the aperture 318 formed in the bottom surface 314 of the mixing tank 50. This diluent having a small portion of liquid raw material 18 ("the rinse solution") thus becomes part of the batch of detergent solution. While en route from the particular drum 34 to the mixing tank 50, the water rinses, or flushes, the diaphragm pump 54, conduit 142, valve 58, and conduit 370. By rinsing these components, the buildup of liquid raw materials 18 is substantially prevented, and the emptied drum 34 may be disposed without regard to leftover materials, that might otherwise be in the drum 34 but for the rinsing. Once the first drum 34 is emptied of the rinse solution, the operator once again manually signals the controller to trigger valves 58, 74 closed and deactivate diaphragm pump 54. This rinsing process, including pumping the diluent into the mixing tank 50, may be repeated more than once for each drum.

Alternatively, the pickup wand 46 may include a fill-level sensor (not shown) to detect the fill-level of the rinse solution in the first drum 34 and signal the controller 406 to trigger valve 162 closed and deactivate the water pump 158, rather than depending on an operator to signal the controller 406. Following this, the controller 406 may trigger valves 58, 74 open and activate diaphragm pump 54 to pump the rinse solution from the drum 34. Further, the low-level sensor may detect the low level of rinse solution remaining in the drum 34, and signal the controller 406 to trigger valves 58, 74 closed and deactivate pump 54.

Once the first drum 34 of liquid raw material 18 is emptied and rinsed, the operator removes the pickup wand 46 from the rinsed drum 34, and inserts the tubular portion 130 of the wand 46 and rinsing cap 150 into another full drum 34 of liquid raw material 18. The previously-described process is again carried out to pump the liquid raw material 18 into the mixing tank 50, rinse the drum 34, and then optionally pump the rinse solution into the mixing tank 50. Further, this process is repeated until all the drums 34 of liquid raw material 18 are sufficiently emptied into the mixing tank 50 and rinsed. A sensor 326 is also mounted on the mixing tank 50 (see FIG. 6) to ensure it is not overfilled.

Also, as previously mentioned, the particulate raw materials 22 may be loaded into the mixing tank 50 either separately from the liquid raw materials 18, or concurrently with the liquid raw materials 18. In one embodiment, the particulate raw materials 22 may be added before the liquid raw materials 18 and the diluted liquid raw materials are added to the mixing tank 50.

After the particulate raw materials 22, liquid raw materials 18, and rinse solution from the drums 34 are mixed into the mixing tank 50 with the initial volume of water, about 850 gallons of mixture or detergent solution is produced in the mixing tank 50. After the raw materials 18, 22 are mixed into the tank 50 with the initial 650 gallons of water, the controller 406 triggers valves 58, 70 open and activates the water pump 158 to "top-off" the mixing tank 50 up to a fill level coinciding with the location of sensor 326 on the mixing tank 50. Once the sensor 326 detects the fill level of the detergent solution, the sensor 326 signals the controller 406 to trigger valves 58, 70 closed and deactivate the water pump 158. In one embodiment, the fill level may be at about 990 gallons of detergent solution.

After the detergent solution is established in the mixing tank 50, it is ready to be dispensed into individual 55-gallon (or other suitable size) drums 402 for transport directly to car washes. Typically, about 17–18 55-gallon drums 402 may be filled from a 990 gallon batch of detergent solution. The fill wands 354 are first inserted into the empty drums 402, such that two drums 402 may or may not be filled simultaneously. Once the fill wands 354 are inserted into the drums 402, the operator manually signals the controller 406 to trigger valves 58, 78, 346, 350 open and activate diaphragm pump 342 to pump detergent solution from the mixing tank 50 to the individual drums 402. The mixture or detergent solution exits the mixing tank 50 through the aperture 318 formed in the bottom surface 314 of the mixing tank 50, flows through conduit 370, through valve 58, through conduit 142, through valve 78, through diaphragm pump 342, and then diverts into two separate parallel flows through respective valves 346, 350 before exiting the fill wands 354. The accumulator 358 (not shown in FIG. 1) is also used to dampen the fluid pulses through the detergent solution as it exits the diaphragm pump 342.

The drums 402 continue to fill with detergent solution until the fill-level sensors on the fill wands 354 detect the fill level of the detergent solution. Due to inconsistencies when filling the drums 402, it is sometimes the case that one of the drums 402 is filled before the other. In such a case, after detecting the fill level of the detergent solution in a particular drum 402, the associated fill-level sensor signals the controller 406 to trigger the associated valve (346, for example) closed, but permit the other valve 350 to remain open and receive the detergent solution pumped by diaphragm pump 342. Finally, when the fill level of the detergent solution is detected by the other sensor, the fill-level sensor signals the controller 406 to trigger valve 342 closed, in addition to closing valves 58, 78 and deactivating the diaphragm pump 342. Also, the operator may manually signal the controller 406 to "top off" the fill level in the individual drums 402 by triggering the appropriate valves (58, 78, and 346) or (58, 78, and 350) open and activating diaphragm pump 342.

In one example of creating a detergent solution, a pre-measured raw chemical material is delivered to a distributor. The pre-measured raw chemical material may comprise two 55-gallon drums of the following formula: Emulsifier Four 38.5%, Mineral Seal Oil 51.3%, Glycol EB 7.7%, T-Det 9.5 2.5%. Each percentage is by weight. The process for making this specific drying agent using the apparatuses and methods discussed above follows:

1. Pump out the first drum 34.
2. Remove pickup wand 46 and place in second drum 34.
3. Pump out second drum 34.
4. Rinse second drum 34 with RO water (about 35 gallons).
5. Agitator 258 will turn on automatically.
6. Pump out rinse solution into mixing tank 50.
7. Remove pickup wand 46 and place in first drum 34.
8. Rinse drum 34 with RO water (about 35 gallons).
9. Pump out rinse solution into tank 50.
10. Let batch stir for 5 minutes.
11. Fill tank 50 to upper sensor 326 with RO water (makes 420 gallons total).

Another mixing tank 378 is shown adjacent the mixing tank 50 in the fluid schematic of FIG. 1. This mixing tank 378 is often utilized to produce a protection product solution, but could also be used to mix colored or fragrant foaming agents. The previously-described processes may also apply to mixing the protection product solution, with the exception that different raw materials are used to produce the protection product solution. For example, particulate raw materials may not be used to produce the protection product solution. Also, a different mixing process other than the previously-mentioned process may be used to produce the protection product solution. For example, the liquid raw material may be initially pumped into the mixing tank 378 before water is introduced into the mixing tank 378 to dilute the liquid raw material. Further, the mixing tank 378 may also include an agitator 380 similar to the agitator 258 in the mixing tank 50 to stir the protection product solution in the mixing tank 378. The agitator 380 may be activated at any time while diluting the liquid raw material to produce the protection product solution.

Also, valve 66 controls the inlet flow of liquid raw materials and water into the mixing tank 378, in addition to controlling the outlet flow of protection product solution from the mixing tank 378 through conduit 382. Similar to the detergent solution, the liquid raw materials to produce the protection product solution are stored in drums (separate from the detergent solution), and the protection product solution itself is pumped into drums for transport to the car washes. Further, both mixing tanks 50, 378 are fluidly connected to a drain 386 through valve 62 and conduit 390. In such cases when rinsing either one or both mixing tanks 50, 378, the rinsing water flows through the valve 62 and conduit 390 before emptying into the drain 386.

The mixing apparatus 14 schematically illustrated in FIG. 1 can also be scaled appropriately, such that other constructions of the mixing apparatus (not shown) include multiple mixing tanks mixing detergent solution (more than one), and further include multiple raw material platforms and inverters to deliver liquid and particulate raw materials, respectively, to the mixing tanks. Further, multiple pumps may be used to fill the mixing tanks with liquid raw materials, and multiple pumps may be used to fill the drums with detergent solution from the mixing tank. Such a construction is possible, in addition to other related constructions, and consistent with the spirit and scope of the present invention.

In this particular industry, chemical suppliers conventionally purchase the raw materials used in producing different detergent and/or protection product solutions from commodity and specialty chemical companies (e.g., Dow Chemical and Du Pont). As used in conventional industry practice, a "chemical supplier" is meant to refer to an entity that provides finished products to the professional carwashing market (e.g., Turtle Wax, Ecolab, and Cleaning Systems, Inc.). The chemical suppliers utilize their expertise to measure portions of the raw materials, mix and dilute the portions of raw materials to produce a particular detergent and/or protection product solution, and package the mixed and diluted detergent and/or protection product solution into individual containers for sale to localized distributors. As used in conventional industry practice, a "conventional distributor" is an entity that is a value-added reseller in the professional carwashing market (e.g., Badgerland Carwash, and Washing Equipment of Texas).

Oftentimes, the per-gallon cost of the diluted detergent and/or protection product solutions from the chemical supplier is often tied to the volume of solution purchased by the distributor. For example, the per-gallon cost to the distributor to purchase 20,000 pounds of diluted detergent and/or protection product solutions is often much higher than the per-gallon cost of 40,000 pounds of the same solutions. However, the conventional distributor is usually only able to sell the detergent and/or protection product solutions for the same price, no matter the initial volume purchased. Thus, in order to receive a profitable discount, or pern-gallon cost from the chemical supplier, the conventional distributor is sometimes required to buy up to 40,000 pounds of product (roughly 80 55-gallon drums) at a time.

The per-gallon cost of the diluted detergent and/or protection product solutions from the chemical supplier may also be tied to the size of container used to package the diluted detergent and/or protection product solutions. For example, the conventional distributor may pay a higher per-gallon cost for 5,000 pounds of the diluted detergent and/or protection product solutions packaged in 5-gallon pails, as opposed to 5,000 pounds of the diluted detergent and/or protection product solutions packaged in 55-gallon drums.

Therefore, the largest profit margins available to the conventional distributor occur when the distributor buys the diluted detergent and/or protection product solutions in bulk volumes and in large containers. This practice often requires the distributor to maintain large quantities of product in stock, which ties up cashflow that could otherwise be better used elsewhere by the distributor. The distributor marks-up and re-sells the individual containers of diluted detergent and/or protection product solutions to end users in its localized marketplace. The end users, as used herein, are the individual car washes or vehicle washing facilities that receive the containers of diluted detergent and/or protection product solutions for use in washing their customer's vehicles. The conventional distributor may also deliver the individual containers of diluted detergent and/or protection product solutions to the end user.

Since the conventional distributor often purchases the diluted detergent and/or protection product solutions in 55-gallon drums, the end users are also often required to purchase the 55-gallon drums of diluted detergent and/or protection product solutions from the distributor. This may be burdensome to the end users, or the individual car washes, since each car wash is set up differently and may or may not have enough space to store 55-gallon drums of diluted detergent and/or protection product solutions. However, if the conventional distributors offer the diluted detergent and/or protection product solutions to the end users in smaller containers (e.g., a 35-gallon drum or a 5-gallon pail), additional burden is placed on the distributor to store and re-package the diluted detergent and/or protection product solutions. Additional exposure to the chemicals is also required.

As previously stated, the chemical suppliers produce the diluted detergent and/or protection product solutions in bulk containers, such as 55-gallon drums. The actual amount of concentrated raw materials used to make the detergent solution, for example, is usually small (under 20%) in comparison to the amount of diluent used to make the detergent solution. The chemical suppliers typically use water, softened water, RO water, or DI water (i.e., de-ionized water) to inexpensively dilute the concentrated raw materials. As a result, a chemical supplier can increase its profit margin by selling the diluted detergent solution instead of only selling the concentrated raw materials. The chemical suppliers deliver the 55-gallon drums to the localized distributors. Delivery of the drums to the conventional distributors can be burdensome due to each truckload comprising eighty or more 55-gallon drums. The distributors must then reload the drums onto their vehicles, and then transport and distribute the drums to the individual car washes in their localized marketplace, which requires additional exposure to the chemicals.

The methods of the present invention provide a way to facilitate manufacture and distribution of the diluted detergent and/or protection product solutions. This is accomplished, in part, by placing the automated mixing apparatus 14 of the present invention at a distributor's facility and by diluting the raw materials at the distributor's facility, rather than at the chemical supplier's facility. The methods and apparatuses of the present invention allow other entities, not previously considered "chemical suppliers" in the traditional industry sense, to utilize their expertise and measure appropriate portions of the raw materials pre-formulate raw materials. The pre-measured raw chemical material of raw materials can then be packaged for delivery to the localized distributors. Further, these entities may utilize their expertise to mix the raw materials into the pre-measured raw chemical material such that the pre-measured raw chemical material is stable for transport to the distributor's facility.

Also, as defined in the methods of the present invention, the "distributor" as used hereinafter is meant to refer to an entity that receives the pre-formulated, pre-measured raw chemical material and provides finished products to the professional car wash market. The distributor, in turn, may dilute the pre-measured raw chemical material using the mixing apparatus 14 to yield a diluted detergent and/or protection product solutions, and package the diluted detergent and/or protection product solutions into containers for delivery to the end users.

The methods of the present invention allow the distributor to utilize the menu-driven operation of the mixing apparatus 14 to dilute the pre-measured raw chemical material. As a result, no special training is required for an operator to utilize the mixing apparatus 14, and the mixing apparatus 14 is sufficiently automated and self-contained such that the operator is substantially not exposed to the pre-measured raw chemical material or the diluted solutions during any time of operation of the mixing apparatus 14. The pre-measured raw chemical material may simply be delivered directly to the distributor on the pallet 39. The distributor may then utilize the menu-driven operation of the mixing apparatus 14 to formulate the diluted detergent and/or protection products. The distributor does not need to (but could) create a special formula, in view of receiving the pre-measured raw chemical material.

Since the pre-measured raw chemical material is in concentrated form, the pre-measured raw chemical material may be packaged and shipped in multiple small containers (e.g., multiple 5-gallon pails), or a single large container (e.g., a single 55-gallon drum). This alleviates the need to double transport (i.e., load and unload, and then load and unload again) the 55-gallon drums, as it is done in conventional industry practice. In other words, instead of the chemical supplier transporting the 55-gallon drums to the distributor, and then the distributor transporting the 55-gallon drums to the end users or individual car washes, pre-measured raw chemical material may be delivered to the distributor for the distributor to produce the diluted detergent and/or protection product solutions on-site and then ship the diluted solutions directly to the individual car washes. This practice reduces exposure to the chemicals, in addition to decreasing delivery costs to the distributor.

The methods and apparatuses of the present invention also allows the distributor to reduce the quantities of the diluted detergent and/or protection product solutions in stock, which is beneficial when space is limited at a distributor's site. This also alleviates the amount of diluted product taking up space. The mixing apparatus 14 allows the distributor to dilute any amount of pre-measured raw chemical material into any number and size of containers for delivery to the individual car washes within a matter of hours. The distributors may use this "just in time" practice to free-up cashflow for other parts of their business.

Additionally, the methods of the present invention also allow the distributors to supply their customers, the individual car washes or vehicle washing facilities, with containers of diluted detergent and/or protection product solutions of any size, including containers as large as tank wagons, 330-gallon IBC's, 250–550 gallon stackable totes, 55-gallon drums, 30-gallon drums, 15-gallon drums, 7.5-gallon drums, and containers as small as 5-gallon pails. This is economically feasible for the distributor because they can manufacture on-site the diluted detergent and/or protection product solutions at the same per gallon cost for smaller size containers (e.g., 5-gallon pails) as the larger size containers (e.g., the 55-gallon drums). This allows the individual car washes to only purchase an amount of the diluted detergent and/or protection product solutions that they can afford at any given time or that they can store at any given time.

The methods of the present invention also allows the distributor the flexibility of concentrating products and uncoupling the aesthetic ratios of protection products. For instance, the dye level, foaming capability, fragrance and drying capabilities of a foam polish can be altered for different individual car washes.

In addition, the methods of the present invention allows the distributor, which is often more physically close and connected with the end user, to tailor the detergent and/or protection product solutions to the demands of individual car washes. Chemical suppliers are typically further removed from individual car washes, and may not have personal contact therewith.

The methods of the present invention also allow the distributors to brand their detergent and/or protection product solutions, with such brands addressing the differing needs of the individual car washes.

The methods and apparatuses of the present invention may also be utilized in connection with the agriculture market, in which fertilizers and/or other agriculture-related chemicals may be mixed according to the methods discussed above.

Various aspects of the invention are set forth in the following claims.

We claim:

1. An apparatus adapted to dilute pre-measured raw chemical material, the apparatus comprising:

a tank selectively fluidly connectable to a source of pressurized diluent by a passageway;

a first pump selectively fluidly connectable to the passageway, the first pump adapted to pump the pre-measured raw chemical material from a first container through the passageway to the tank to mix with diluent in the tank; and a second pump selectively fluidly connectable to the passageway, the second pump adapted to pump the diluted raw chemical material from the tank through the passageway to a second container.

2. The apparatus of claim 1, further comprising a platform supporting the first pump, the second pump, and the pre-measured raw chemical material.

3. The apparatus of claim 1, further comprising a first wand fluidly connected to the first pump and insertable into the first container to pump the pre-measured raw chemical material from the first container to the tank.

4. The apparatus of claim 1, further comprising a second wand fluidly connected to the second pump and insertable into the second container to pump the diluted raw chemical material from the tank to the second container.

5. The apparatus of claim 1, further comprising a conduit in selective communication with the passageway and fluidly connected with the first container, the conduit being configured to deliver diluent to the first container after the first container is substantially emptied to form a rinse solution.

6. The apparatus of claim 5, further comprising a rinsing cap around the conduit to deliver the diluent to the first container.

7. The apparatus of claim 5, wherein the first pump is configured to pump the rinse solution to the tank.

8. The apparatus of claim 1, further comprising an inverter configured to spill the pre-measured raw chemical material into the tank.

9. The apparatus of claim 8, wherein a third container is movable by the inverter between a lowered position, in which the pre-measured raw chemical material is loaded into the third container, and a substantially inverted position, in which the pre-measured raw chemical material spills out of the third container and into the tank.

10. The apparatus of claim 9, wherein the third container contains at least one bag of particulate raw chemical materials, and wherein the particulate raw chemical materials spill from the bag and the third container when the third container is in the substantially inverted position.

11. The apparatus of claim 9, wherein the pre-measured raw chemical material includes liquid raw chemical material in the first container and particulate raw chemical material in the third container.

12. The apparatus of claim 1, further comprising a controller to selectively operate the first and second pumps.

13. The apparatus of claim 1, wherein the platform maintains spill control and containment.

14. The apparatus of claim 1, wherein the passageway defines a common inlet into the tank and an outlet from the tank.

* * * * *